US011492716B2

(12) United States Patent
Allaire

(10) Patent No.: US 11,492,716 B2
(45) Date of Patent: Nov. 8, 2022

(54) MATERIAL COMPONENTS PROTECTION AGAINST THE CORROSIVE ACTION CRYOLITE MELTS IN ALUMINIUM REDUCTION CELLS

(71) Applicant: Laboratoire CIR inc., Blainville (CA)

(72) Inventor: Claude Allaire, St-Eustache (CA)

(73) Assignee: LABORATOIRE CIR INC., Blainville (CA)

( * ) Notice: Subject to any disclaimer, the term of this patent is extended or adjusted under 35 U.S.C. 154(b) by 63 days.

(21) Appl. No.: 17/072,216

(22) PCT Filed: Apr. 16, 2019

(86) PCT No.: PCT/CA2019/050469
§ 371 (c)(1),
(2) Date: Oct. 16, 2020

(87) PCT Pub. No.: WO2019/200470
PCT Pub. Date: Oct. 24, 2019

(65) Prior Publication Data

US 2022/0090279 A1 Mar. 24, 2022

Related U.S. Application Data

(60) Provisional application No. 62/658,029, filed on Apr. 16, 2018.

(51) Int. Cl.
*C25C 3/08* (2006.01)
*C25C 3/12* (2006.01)

(52) U.S. Cl.
CPC ..... *C25C 3/08* (2013.01); *C25C 3/125* (2013.01)

(58) Field of Classification Search
CPC ..... C25C 3/06–3/24
See application file for complete search history.

(56) References Cited

U.S. PATENT DOCUMENTS 3,434,957 A * 3/1969 Johnson ..... C25C 3/08 205/374
4,877,507 A * 10/1989 Hudson ..... C25C 3/085 501/153

(Continued)

FOREIGN PATENT DOCUMENTS

CA 2131287 10/1993
GB 1068803 5/1967

(Continued)

OTHER PUBLICATIONS

Supplementary European Search Report for application EP 19 78 9140 (European National Stage entry of corresponding PCT application), dated Dec. 2021 (Year: 2021).*

(Continued)

*Primary Examiner* — Harry D Wilkins, III
(74) *Attorney, Agent, or Firm* — Benoit & Cote, Inc.; Mathieu Miron

(57) ABSTRACT

The present document describes an electrolytic cell comprising a protective layer comprising elemental copper covering at least in part or all of a refractory material assembly covering an interior surface thereof. Also described is a copper oxide containing composition comprising copper oxide and any one of a reducing agent and a binder. Also described is a method of protecting a refractory material assembly covering an interior surface of an electrolytic cell, comprising covering at least in part, or all of the refractory material assembly with a copper sheet, a structure comprising elemental copper, a copper oxide, an elemental copper comprising composite material, a copper oxide containing composition and combinations thereof, to provide a protective layer comprising elemental copper.

18 Claims, 11 Drawing Sheets

(56) References Cited

U.S. PATENT DOCUMENTS

| | | | | | |
|---|---|---|---|---|---|
| 4,999,097 | A * | 3/1991 | Sadoway | C25C 7/025 | 204/290.13 |
| 5,149,412 | A * | 9/1992 | Allaire | C04B 33/1322 | 204/247.4 |
| 5,284,562 | A | 2/1994 | Beck et al. | | |
| 5,314,599 | A * | 5/1994 | Allaire | C25C 3/085 | 266/286 |
| 5,409,580 | A * | 4/1995 | Gesing | C25C 3/04 | 204/245 |
| 2003/0224220 | A1 * | 12/2003 | Nguyen | C04B 41/507 | 428/702 |

FOREIGN PATENT DOCUMENTS

| | | | | |
|---|---|---|---|---|
| WO | WO 01/42531 | A1 * | 6/2001 | C25C 3/08 |
| WO | WO 02/070783 | A1 * | 9/2002 | C25C 3/08 |

OTHER PUBLICATIONS

European Search Opinion for application EP 19 78 9140 (European National Stage entry of corresponding PCT application), dated Dec. 2021 (Year: 2021).*

International Search Report of PCT/CA2019/050469; dated Jul. 2, 2019: Menard, Randall.

* cited by examiner

Anode supporting assembly

MATERIAL COMPONENTS PROTECTION AGAINST THE CORROSIVE ACTION CRYOLITE MELTS IN ALUMINIUM REDUCTION CELLS

This application is a US National Phase application under 35 USC § 371 of PCT/CA2019/050469, filed Apr. 16, 2019, which claims priority from and the benefit of United States Provisional Patent Application No. 62/658,029, filed Apr. 16, 2018, the specifications of which are hereby incorporated by reference in their entireties.

BACKGROUND

(a) Field

The subject matter of the present invention generally relates to aluminum production. More specifically, the present invention relates to the protection of the component materials used in aluminum reduction cells, mainly the pot lining refractories and the anode studs.

(b) Related Prior Art

Aluminum reduction cells used in the Hall-Héroult process are lined with refractory materials underneath the carbon cathode blocks. Some elements contained in the molten electrolyte used in such cells can diffuse in the refractory materials and react therewith to reduce their effectiveness. This can shorten the useful lifetime of the cell, in addition to forming toxic compounds. The refractory materials thus require decontamination before disposal, at the end of the cell life.

Against this background, there exists a need in the industry to protect the potlining refractory materials in aluminum reduction cells.

There also exists a need in the industry to provide an inert anode.

SUMMARY

In a broad aspect, there is provided an electrolytic cell comprising: a shell defining an interior surface; a refractory material assembly covering the interior surface at the bottom of the shell; carbon cathode blocks on top of the refractory assembly; a granular oxide-based layer (bedding mix) between the cathode blocks and the refractory assembly; a protective layer covering at least in part the refractory material just below the bedding mix; a molten aluminum layer on top of the cathode blocks, a molten electrolyte above the aluminum layer; carbon anodes in contact with the electrolyte; wherein the electrolyte includes cryolite and the protective layer includes copper.

In another broad aspect, there is provided an electrolytic cell comprising: a shell defining an interior surface; a refractory material covering the interior surface a protective layer covering at least in part the refractory material opposed to the interior surface, an electrolyte contained in the electrolytic cell; a cathode and an anode in contact with the electrolyte; wherein the electrolyte includes cryolite and the protective layer includes copper.

In another broad aspect, there is provided a method for protecting refractory materials and/or insulating bricks and/or panels covering the interior surface of an electrolytic cell, the method comprising covering at least in part the refractory materials with a copper containing compound prior to filling the electrolytic cell with an electrolyte.

In another broad aspect, there is provided a material comprising: between about 35 percent and 95 percent w/w of a copper oxide powder; and between about 5 and about 15 percent of a graphite powder.

In another broad aspect, there is provided a material comprising: between about 35 percent and 99 percent w/w of a copper oxide powder; and between about 1 and about 10 percent of colloidal silica.

In another broad aspect, there is provided a method for manufacturing a copper oxide ceramic plate, the method comprising exposing a copper plate to an oxidizing atmosphere at a temperature between about 900° C. and about 1050° C.

Advantageously, the invention provides novel methods and compositions of matter for protecting material components of electrolytic cells to increase their useful life at relatively small costs. The proposed compositions of matter are, in some embodiments, relatively easily applied to the materials to protect. Also, in some embodiments, the protection provided by the invention, allows using a thinner layer of refractory materials to line the electrolytic cell.

Other objects, advantages and features of the present invention will become more apparent upon reading of the following non-restrictive description of preferred embodiments thereof, given by way of example only with reference to the accompanying drawings.

According to an embodiment, there is provided an electrolytic cell comprising a protective layer comprising elemental copper covering at least in part or all of a refractory material assembly covering an interior surface thereof.

The protective layer comprising elemental copper may comprise a copper sheet, a structure comprising elemental copper, a copper oxide, an elemental copper comprising composite material, a copper oxide containing composition, and combinations thereof.

The protective layer comprising elemental copper may comprises a plurality of copper sheets, and the copper oxide, the elemental copper comprising composite material, the copper oxide containing composition or combinations thereof, between the copper sheets.

The copper oxide or the copper oxide containing composition may be in powder form, paste form, mortar form, slurry form, grouting form, or combinations thereof.

The copper oxide containing composition may comprise from about 35 to 100% w/w of the copper oxide.

The copper oxide may be CuO, $Cu_2O$, $CuO_2$; $Cu_2O_3$, or a combination thereof, preferably CuO, $Cu_2O$, or a combination thereof.

The copper oxide containing composition may further comprise a reducible copper containing compound.

The copper oxide containing composition may comprise from about 35 to 100% w/w of the copper oxide and the reducible copper containing compound.

The copper oxide containing composition may further comprise an elemental copper particle.

The copper oxide containing composition may further comprise a reducing agent, a lubricating agent, a filler material, a binder, water, and combinations thereof.

The reducing agent may be graphite, lithium aluminium hydride ($LiAlH_4$), diborane sodium borohydride ($NaBH_4$), compounds containing the Fe2+ ion, such as iron(II) sulfate, compounds containing the Sn2+ ion, such as tin(II) chloride, sulfur dioxide (sometimes also used as an oxidizing agent), sulfite compounds, dithionates, e.g. $Na_2S_2O_6$, thiosulfates, e.g. $Na_2S_2O_3$, Iodides, e.g. KI, Cyanides in hydrochemical metallurgical processes, carbon (C) forms distinct from graphite, or combinations thereof.

The lubricating agent may be graphite, molybdenum disulfide ($MoS_2$), boron nitrite (BN, h-BN), polytetrafluorethylene (PTFE), or combinations thereof.

The lubricating agent or the reducing agent is from about 5 to about 15% w/w of the composition.

The graphite may be from about 5 to about 15% w/w of the composition.

The filler material may be silicon carbide (SiC), ground calcium carbonate (GCC), precipitated calcium carbonate (PCC), kaolin, talc, Wollastonite (CaSiO3), Silica (Precipitated), glass, carbon black, or combinations thereof.

The filler material may be from about 0 to about 25% w/w of the composition.

The SiC may be from about 0 to about 25% w/w of the composition.

The binder may be bentonite, kaolinite, halloysite, phyrophillite, monmorillonite, or combinations thereof.

The binder may be from about 0 to about 15% w/w of the composition.

The copper oxide copper oxide containing composition may contain copper oxide particles of about 10 μm to about 200 μm.

The filler material may have a particle size of from about 75 μm to about 3350 μm.

The binder may have a particle size of about 10 μm to about 44 μm.

The electrolytic cell may comprise a shell defining the interior surface, the refractory material assembly covering the interior surface at a bottom of the shell.

The electrolytic cell may comprise a cathode on top of the refractory material assembly.

The electrolytic cell may comprise a granular oxide-based layer covering the protective layer.

The electrolytic cell may comprise a molten aluminum layer on top of the cathode.

The electrolytic cell may comprise a carbon anode.

The electrolytic cell may comprise a molten electrolyte comprising cryolite, above the aluminum layer.

The carbon anode may be contacting the molten electrolyte.

The electrolytic cell may comprise

- a shell defining the interior surface, the refractory material assembly covering the interior surface at a bottom of the shell;
- a protective layer comprising elemental copper covering at least in part the refractory material assembly;
- a cathode on top of the refractory material assembly;
- a granular oxide-based layer covering the protective layer;
- a molten aluminum layer on top of the cathode block;
- a molten electrolyte comprising cryolite, above the molten aluminum layer;
- a carbon anode contacting the molten electrolyte.

The protective layer comprising elemental copper formed from the copper oxide containing composition may be a randomly arranged, continuous copper containing ceramic matrix comprising a plurality of continuous copper paths in electrical communication with the refractory material assembly on one side, and the electrolyte on the other side.

The elemental copper comprising composite material may be a randomly arranged, continuous copper containing ceramic matrix comprising a plurality of continuous copper paths in electrical communication with the refractory material assembly on one side, and the electrolyte on the other side.

According to another embodiment, there is provided a copper oxide containing composition comprising from about 35 to 99% w/w of the copper oxide; and any one of

- from about 5 to about 15% w/w of a reducing agent;
- from about 1 to about 10% w/w of a binder;
- or combinations thereof.

The copper oxide is CuO, $Cu_2O$, $CuO_2$, $Cu2O_3$ or a combination thereof, preferably CuO, $Cu_2O$, or a combination thereof.

The copper oxide containing composition may further comprise a reducible copper containing compound.

The copper oxide containing composition comprises from about 35 to 100% w/w of the copper oxide and the reducible copper containing compound.

The copper oxide containing composition may further comprises an elemental copper particle.

The reducing agent may be graphite, lithium aluminium hydride ($LiAlH_4$), diborane sodium borohydride ($NaBH_4$), compounds containing the Fe2+ ion, such as iron(II) sulfate, compounds containing the Sn2+ ion, such as tin(II) chloride, sulfur dioxide (sometimes also used as an oxidizing agent), sulfite compounds, dithionates, e.g. $Na_2S_2O_6$, thiosulfates, e.g. $Na_2S_2O_3$, Iodides, e.g. KI, Cyanides in hydrochemical metallurgical processes, carbon (C) forms distinct from graphite, or combinations thereof.

The binder may be colloidal silica.

The copper oxide containing composition further comprises, a lubricating agent, a filler material, water, and combinations thereof.

The lubricating agent may be graphite, molybdenum disulfide ($MoS_2$), boron nitrite (BN, h-BN), polytetrafluorethylene (PTFE), or combinations thereof.

The lubricating agent or the reducing agent may be from about 5 to about 15% w/w of the composition.

The graphite may be from about 5 to about 15% w/w of the composition.

The filler material may be silicon carbide (SiC), ground calcium carbonate (GCC), precipitated calcium carbonate (PCC), kaolin, talc, Wollastonite (CaSiO3), Silica (Precipitated), glass, carbon black, or combinations thereof.

The filler material may be from about 0 to about 25% w/w of the composition.

The SiC may be from about 0 to about 25% w/w of the composition.

The binder may be bentonite, kaolinite, halloysite, phyrophillite, monmorillonite, or combinations thereof.

The binder may be from about 0 to about 15% w/w of the composition.

The copper oxide copper oxide containing composition may contain copper oxide particles of about 10 μm to about 200 μm.

The filler material may have a particle size of from about 75 μm to about 3350 μm.

The binder may have a particle size of about 10 μm to about 44 μm.

The copper oxide containing composition may be in powder form, paste form, mortar form, slurry form, grouting form, or combinations thereof.

The electrolytic cell of the present invention, or the copper oxide containing composition of the present invention, wherein the reducible copper containing compound may comprises

- copper sulfates such as $CuSO_4(H_2O)_x$ where x is 0 to 5, and which includes cupric sulfate, $CuSO_4$);

copper carbonates such as copper(II) carbonate hydroxides [$Cu_3(CO_3)_2(OH)_2$, and $Cu_2CO_3(OH)_2$], copper(II) carbonate [$CuCO_3$], and copper(I) carbonate [$Cu_2CO_3$], and copper phosphates, such as for example Copper(II) phosphate [$Cu_3(PO_4)_2$], Copper(I) phosphate [$Cu_3PO_4$], turquoise [$CuAl_6(PO_4)_4(OH)_8.4H_2O$], cornetite, libethenite, sampleite [$NaCaCu_5(PO_4)_4Cl.5(H_2O)$].

According to another embodiment, there is provided a method of protecting a refractory material assembly covering an interior surface of an electrolytic cell, comprising covering at least in part, or all of the refractory material assembly with a copper sheet, a structure comprising elemental copper, a copper oxide, an elemental copper comprising composite material, a copper oxide containing composition and combinations thereof, to provide a protective layer comprising elemental copper.

The copper oxide containing composition may be the copper oxide containing composition according to the present invention.

The covering may be performed prior to filing the electrolytic cell with an electrolyte.

The method may further comprise the step of using the electrolytic cell under an oxidizing atmosphere.

The method may further comprise the step of using the electrolytic cell under at a temperature between about 900° C. and 1050° C.

The step provides conversion of the copper oxide, the elemental copper comprising composite material, the copper oxide containing composition and combinations thereof to elemental copper.

The protective layer comprising elemental copper may be from a thickness of about 1 mm to about 6.5 mm.

The protective layer comprising elemental copper comprises a randomly arranged, continuous copper containing ceramic matrix comprising a plurality of continuous copper paths in electrical communication with the refractory material assembly on one side and the electrolyte on the other side.

The protective layer comprising elemental copper formed from the copper oxide containing composition may be a randomly arranged, continuous copper containing ceramic matrix comprising a plurality of continuous copper paths in electrical communication with the refractory material assembly on one side, and the electrolyte on the other side.

The elemental copper comprising composite material may be a randomly arranged, continuous copper containing ceramic matrix comprising a plurality of continuous copper paths in electrical communication with the refractory material assembly on one side and the electrolyte on the other side.

According to another embodiment, there is provided an inert anode assembly comprising an inner electrically conducive core comprising a first end coated with a first coating comprising an elemental copper coating, a structure comprising elemental copper, a copper oxide, an elemental copper comprising composite material, a copper oxide containing composition, and combinations thereof, the first end configured to contact a cryolitic bath, and a second end, configured to be electrically joined to a current source.

The inner electrically conducive core may be a metallic core.

The copper oxide containing composition may be the copper oxide containing composition according to the present invention.

The inert anode assembly may further comprise a second coating, coating the inner electrically conducive core over a region of the inner electrically conducive core adjacent to the first coating.

The first coating may be an elemental copper coating.

The metallic core may be an iron core.

The following terms are defined below.

The term "carbon material" is intended to mean an object or item that is made from carbon (i.e., graphite, petroleum or metallurgical coke or any other partially graphitized carbon, amorphous carbon) such as prebaked consumable carbon anodes used in the process of aluminum smelting.

The term "copper oxide" is intended to mean any compound that comprises copper and oxygen atoms that may be used in the products and methods of the present invention. Copper oxides refer to compound from the two elements copper and oxygen, and may refer to Copper(I) oxide (cuprous oxide, $Cu_2O$); Copper(II) oxide (cupric oxide, CuO); Copper peroxide ($CuO_2$); Copper(II) oxide ($Cu_2O_3$). In preferred embodiments of the present invention, the copper oxides are Copper(I) oxide (cuprous oxide, $Cu_2O$); Copper(II) oxide (cupric oxide, CuO).

The terms "copper" and "elemental copper" are intended to mean the chemical element with symbol Cu (from Latin: cuprum) and atomic number 29. It is a soft, malleable, and ductile metal with very high thermal and electrical conductivity.

The terms "composite material" or "composite" are intended to mean a material made from two or more constituent materials with significantly different physical or chemical properties that, when combined, produce a material with characteristics different from the individual components. The individual components remain separate and distinct within the finished structure, differentiating composites from mixtures and solid solutions.

The term "ceramic" is intended to mean a solid material comprising an inorganic compound of metal, non-metal or metalloid atoms primarily held in ionic and covalent bonds. Common examples are earthenware, porcelain, and brick.

The term "Ceramic matrix composite" is intended to mean a subgroup of composite materials as well as a subgroup of ceramics. It consists of ceramic fibres embedded in a ceramic matrix. The matrix and fibres can consist of any ceramic material, whereby carbon and carbon fibres (e.g. silicon carbide, SiC) can also be considered a ceramic material.

The term "arranged, continuous copper containing ceramic matrix" is intended to mean the compound is converted in a copper metal matrix composite.

The term "continuous copper paths in electrical communication with the refractory material assembly on one side and the electrolyte on the other side" is intended to mean copper is accessible from each side of the matrix.

Terms such as "substantially", "about" and "essentially" are used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed an electrolytic cell comprising a protective layer comprising elemental copper covering at least in part a refractory material assembly covering an interior surface thereof.

According to embodiments, the protective layer comprising elemental copper may comprise a copper sheet, a structure comprising elemental copper, a copper oxide, an elemental copper comprising composite material, a copper oxide containing composition, and combinations thereof. According to another embodiment, the protective layer comprising elemental copper may comprise a plurality of copper sheets, and the copper oxide, elemental copper comprising composite material, copper oxide containing composition or combinations thereof, between the copper sheets.

Figure 1:
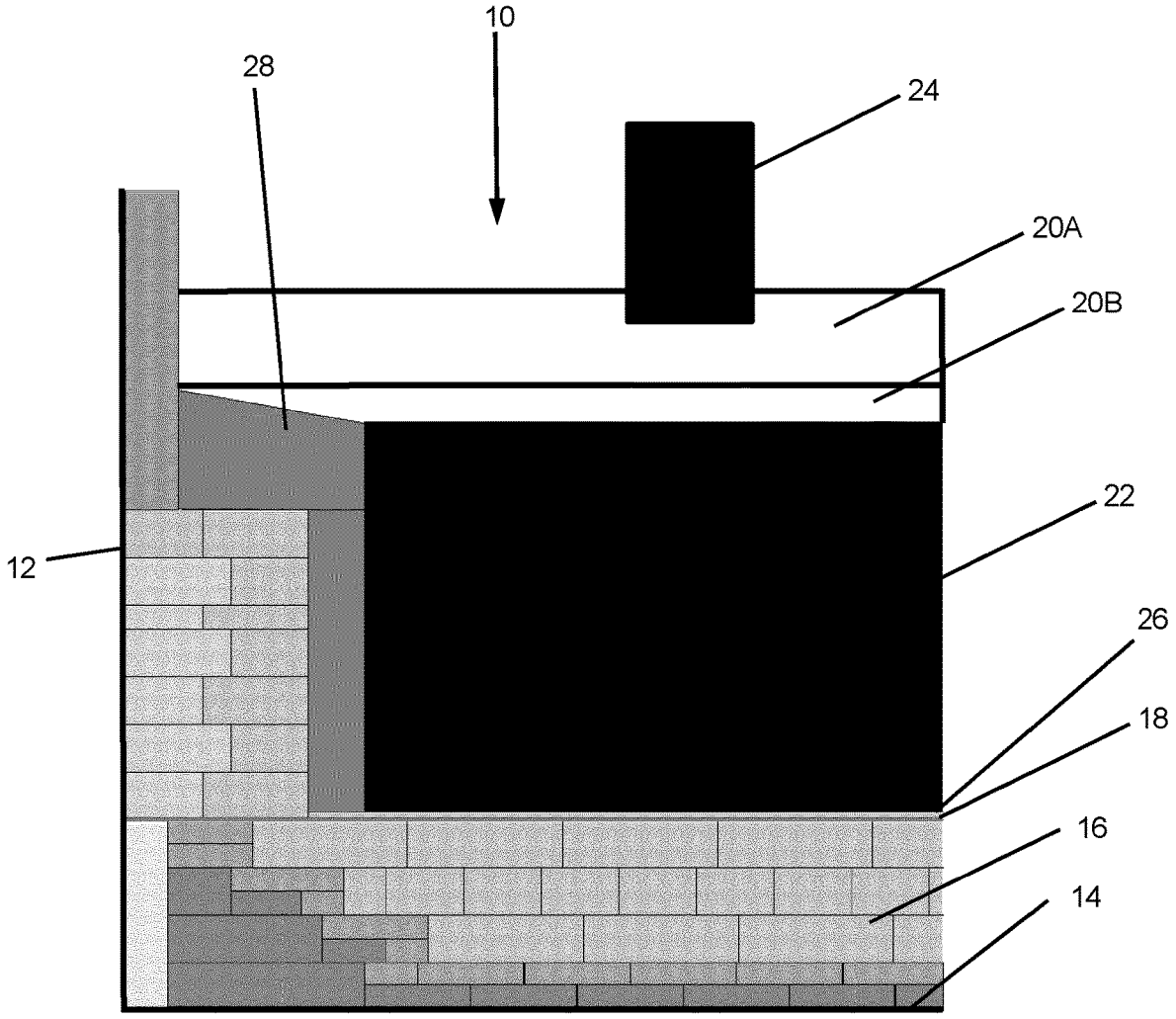
FIG. 1, in a schematic cross-sectional view, illustrates an electrolytic cell in accordance with an embodiment of the present invention.

Now referring to FIG. 1, there is shown an exemplary electrolytic cell 10, which comprises a shell 12 defining an interior surface 14. A refractory material 16 covers the interior surface 14. A protective layer 18 covers at least in part the refractory material 16 opposed to the interior surface 14. An electrolyte 20 (A) on top of an aluminum layer 20 (B) are contained in the electrolytic cell 10. A cathode 22 and an anode 24 are in contact with the aluminum layer 20 (B) and the electrolyte 20 (A), respectively. The electrolyte 20 may include cryolite and the protective layer 18 includes copper.

The electrolytic cell 10 is for example similar to conventional electrolytic cells used to perform the Hall-Héroult process. In such cases, the electrolyte includes cryolite and the anode 24 and cathode 22 are currently made from carbonaceous materials. In some embodiments, the cathode 22 covers substantially entirely the bottom of the electrolytic cell 10 and a bedding mix 26 may be provided between the protective layer 18 and the cathode 22. However, in other embodiments, the protective layer 18 also acts as the bedding mix and no additional bedding mix 26 is required. The anode can be embedded in a mixture of carbon and resin 28.

In another embodiment, the electrolytic cell comprises a shell 10 defining the interior surface 14, the refractory material assembly 16 covering the interior surface 14 at a bottom of the shell 12.

In an embodiment, the electrolytic cell 10 comprises a cathode (i.e. cathode block 22) on top of the refractory material assembly 16. In another embodiment, the electrolytic cell 10 comprises a granular oxide-based layer (bedding mix 26) covering the protective layer 18. However, in other embodiments, the protective layer 18 also acts as the bedding mix and no additional bedding mix 26 is required. In another embodiment, the electrolytic cell comprises a molten aluminum layer 20 on top of the cathode block 22. In embodiment, the electrolytic cell 10 comprises a carbon anode 24. In another embodiment, the electrolytic cell 10 comprises a molten electrolyte comprising cryolite, above the aluminum layer. In embodiments, carbon anode 24 is contacting the molten electrolyte.

The refractory materials are conventional and include for examples outer layers of vermiculite boards, closer to the interior surface 14, covered by high density refractory bricks (for example 80% or more $SiO_2$, or 80% or less $SiO_2$, or combinations thereof, with the remainder of the brick consisting mostly of alumina). It should be noted that the protective layer 18 may also be used with other configurations and types of electrolytic cells 10.

The protective layer 18 comprises elemental copper. In some embodiments, the protective layer consists in a copper sheet, or in overlapping copper sheets, or in any other suitable structure including elemental copper. In other embodiments, the protective layer 18 includes a copper oxide, for example CuO, $Cu_2O$, $CuO_2$; $Cu_2O_3$, or a mixture thereof. Preferably, CuO, $Cu_2O$. The copper oxide may be in powder form or in bulk form, or as part of a copper containing composition. In another embodiment, the protective layer 18 comprises an elemental copper comprising composite material. In another example, the protective layer 18 includes overlapping copper sheets and the overlap between adjacent copper sheets includes a copper oxide, a structure comprising elemental copper, an elemental copper comprising composite material, a copper oxide containing composition, and combinations thereof, such mixture or structures being applied between the copper sheets. Other components, described further below, may be also part of the protective layer 18.

In embodiments, it should be noted that if a copper oxide is used in a newly installed electrolytic cell, it may happen that in operation, diffusion of reducing elements from the electrolyte 20 through the protective layer 18 causes reduction of the copper oxide to elemental copper. This elemental copper may then form a continuous layer blocking further diffusion of the reducing elements through the protective layer 18, or form a porous or discontinuous layer still allowing diffusion of the reducing elements through the protective layer 18, but to a smaller extend than if the protective layer 18 was absent. Therefore, the proposed protective layer 18 would ideally completely block diffusion of elements contained in the electrolyte 20 toward the refractory material 16, but protective layers 18 partially blocking this diffusion are also within the scope of the invention.

In some embodiments, the material included in the protective layer 18, hereinafter "the protective material", has the following formulations when first applied in a new electrolytic cell 10. When no water is contained in the protective material, the protective material is in powder form. When water is contained in the protective material, the protective material is the form of a paste, mortar, slurry or grouting, depending on the water content. Therefore, the copper oxide or the copper oxide containing composition may be in powder form, paste form, mortar form, slurry form, grouting form, or combinations thereof.

In an embodiment, the first component of the protective material is a copper oxide. For example, the protective material contains between about 35% and about 100% w/w, or from about 40% to about 100% w/w, or from about 45% to about 100% w/w, or from about 50% to about 100% w/w, or from about 55% to about 100% w/w, or from about 60% to about 100% w/w, or from about 65% to about 100% w/w, or from about 70% to about 100% w/w, or from about 75% to about 100% w/w, or from about 80% to about 100% w/w, or from about 85% to about 100% w/w, or from about 90% to about 100% w/w, or from about 95% to about 100% w/w, or about 35% and about 95% w/w, or from about 40% to about 95% w/w, or from about 45% to about 95% w/w, or from about 50% to about 95% w/w, or from about 55% to about 95% w/w, or from about 60% to about 95% w/w, or from about 65% to about 95% w/w, or from about 70% to about 95% w/w, or from about 75% to about 95% w/w, or from about 80% to about 95% w/w, or from about 85% to about 95% w/w, or from about 90% to about 95% w/w, or about 35% and about 90% w/w, or from about 40% to about 90% w/w, or from about 45% to about 90% w/w, or from about 50% to about 90% w/w, or from about 55% to about 90% w/w, or from about 60% to about 90% w/w, or from about 65% to about 90% w/w, or from about 70% to about 90% w/w, or from about 75% to about 90% w/w, or from about 80% to about 90% w/w, or from about 85% to about 90% w/w, or about 35% and about 85% w/w, or from about 40% to about 85% w/w, or from about 45% to about 85% w/w, or from about 50% to about 85% w/w, or from about 55% to about 85% w/w, or from about 60% to about 85% w/w, or from about 65% to about 85% w/w, or from about 70% to about 85% w/w, or from about 75% to about 85% w/w, or from about 80% to about 85% w/w, or about 35% and about 80% w/w, or from about 40% to about 80% w/w, or from about 45% to about 80% w/w, or from about 50% to about 80% w/w, or from about 55% to about 80% w/w, or from about 60% to about 80% w/w, or from about 65% to about 80% w/w, or from about 70% to about 80% w/w, or from about 75% to about 80% w/w, or about 35% and about 75% w/w, or from about 40% to about 75% w/w, or from about 45% to about 75% w/w, or from about 50% to about 75% w/w, or from about 55% to about 75% w/w, or from about 60% to about 75% w/w, or from about 65% to about 75% w/w, or from about 70% to about 75% w/w, or about 35% and about 65% w/w, or from about 40% to about 65% w/w, or from about 45% to about 65% w/w, or from about 50% to about 65% w/w, or from about 55% to about 65% w/w, or from about 60% to about 65% w/w, or from about 65% to about 65% w/w, or about 35% and about 60% w/w, or from about 40% to about 60% w/w, or from about 45% to about 60% w/w, or from about 50% to about 60% w/w, or from about 55% to about 60% w/w, or about 35% and about 55% w/w, or from about 40% to about 55% w/w, or from about 45% to about 55% w/w, or from about 50% to about 55% w/w, or about 35% and about 50% w/w, or from about 40% to about 50% w/w, or from about 45% to about 50% w/w, or about 35% and about 45% w/w, or from about 40% to about 45% w/w, or from about 35% to about 40% w/w of copper oxide, e.g. CuO, $Cu_2O$, $CuO_2$; $Cu_2O_3$, or a mixture thereof in any proportion.

In other embodiments, the protective materials may include less than 35% w/w copper oxide. For example, one or more other reducible copper containing compounds could be mixed with the copper oxide. Examples of other reducible copper containing compounds include copper sulfates such as $CuSO_4(H_2O)_x$ where x is 0 to 5, and which includes cupric sulfate, $CuSO_4$); copper carbonates such as copper(II) carbonate hydroxides [$Cu_3(CO_3)_2(OH)_2$, and $Cu_2CO_3(OH)_2$], copper(II) carbonate [$CuCO_3$], and copper(I) carbonate [$Cu_2CO_3$], and copper phosphates, such as for example Copper(II) phosphate [$Cu_3(PO_4)_2$], Copper(I) phosphate [$Cu_3PO_4$], turquoise [$CuAl_6(PO_4)_4(OH)_3.4H_2O$], cornetite, libethenite, sampleite [$NaCaCu_5(PO_4)_4Cl.5(H_2O)$]. Thus, in embodiment, the protective material may comprise copper oxide containing compositions which comprise from about 35% and about 100% w/w, or from about 40% to about 100% w/w, or from about 40% to about 100% w/w, or from about 45% to about 100% w/w, or from about 50% to about 100% w/w, or from about 55% to about 100% w/w, or from about 60% to about 100% w/w, or from about 65% to about 100% w/w, or from about 70% to about 100% w/w, or from about 75% to about 100% w/w, or from about 80% to about 100% w/w, or from about 85% to about 100% w/w, or from about 90% to about 100% w/w, or from about 95% to about 100% w/w, or about 35% and about 95% w/w, or from about 40% to about 95% w/w, or from about 45% to about 95% w/w, or from about 50% to about 95% w/w, or from about 55% to about 95% w/w, or from about 60% to about 95% w/w, or from about 65% to about 95% w/w, or from about 70% to about 95% w/w, or from about 75% to about 95% w/w, or from about 80% to about 95% w/w, or from about 85% to about 95% w/w, or from about 90% to about 95% w/w, or about 35% and about 90% w/w, or from about 40% to about 90% w/w, or from about 45% to about 90% w/w, or from about 50% to about 90% w/w, or from about 55% to about 90% w/w, or from about 60% to about 90% w/w, or from about 65% to about 90% w/w, or from about 70% to about 90% w/w, or from about 75% to about 90% w/w, or from about 80% to about 90% w/w, or from about 85% to about 90% w/w, or about 35% and about 85% w/w, or from about 40% to about 85% w/w, or from about 45% to about 85% w/w, or from about 50% to about 85% w/w, or from about 55% to about 85% w/w, or from about 60% to about 85% w/w, or from about 65% to about 85% w/w, or from about 70% to about 85% w/w, or from about 75% to about 85% w/w, or from about 80% to about 85% w/w, or about 35% and about 80% w/w, or from about 40% to about 80% w/w, or from about 45% to about 80% w/w, or from about 50% to about 80% w/w, or from about 55% to about 80% w/w, or from about 60% to about 80% w/w, or from about 65% to about 80% w/w, or from about 70% to about 80% w/w, or from about 75% to about 80% w/w, or about 35% and about 75% w/w, or from about 40% to about 75% w/w, or from about 45% to about 75% w/w, or from about 50% to about 75% w/w, or from about 55% to about 75% w/w, or from about 60% to about 75% w/w, or from about 65% to about 75% w/w, or from about 70% to about 75% w/w, or about 35% and about 65% w/w, or from about 40% to about 65% w/w, or from about 45% to about 65% w/w, or from about 50% to about 65% w/w, or from about 55% to about 65% w/w, or from about 60% to about 65% w/w, or from about 65% to about 65% w/w, or about 35% and about 60% w/w, or from about 40% to about 60% w/w, or from about 45% to about 60% w/w, or from about 50% to about 60% w/w, or from about 55% to about 60% w/w, or about 35% and about 55% w/w, or from about 40% to about 55% w/w, or from about 45% to about 55% w/w, or from about 50% to about 55% w/w, or about 35% and about 50% w/w, or from about 40% to about 50% w/w, or from about 45% to about 50% w/w, or about 35% and about 45% w/w, or from about 40% to about 45% w/w, or from about 35% to about 40% w/w of copper oxide and reducible copper containing compound.

In examples of some embodiments, the copper oxide includes CuO, $Cu_2O$, $CuO_2$; $Cu_2O_3$, particles having a size smaller than about 270 Tyler mesh (about 53 microns). However, larger and smaller particle sizes are within the scope of the invention, for example particles smaller than 150 μm. Particles may therefore range from about 10 μm to about 200 μm, or from about 20 μm to about 200 μm, or from about 30 μm to about 200 μm, or from about 40 μm to about 200 μm, or from about 50 μm to about 200 μm, or from about 53 μm to about 200 μm, or from about 60 μm to about 200 μm, or from about 70 μm to about 200 μm, or from about 80 μm to about 200 μm, or from about 90 μm to about 200 μm, or from about 100 μm to about 200 μm, or from about 110 μm to about 200 μm, or from about 120 μm to about 200 μm, or from about 130 μm to about 200 μm, or from about 140 μm to about 200 μm, or from about 150 μm to about 200 μm, or from about 160 μm to about 200 μm, or from about 170 μm to about 200 μm, or from about 180 μm to about 200 μm, or from about 190 μm to about 200 μm, or from about 10 μm to about 190 μm, or from about 20 μm to about 190 μm, or from about 30 μm to about 190 μm, or from about 40 μm to about 190 μm, or from about 50 μm to about 190 μm, or from about 53 μm to about 190 μm, or from about 60 μm to about 190 μm, or from about 70 μm to about 190 μm, or from about 80 μm to about 190 μm, or from about 90 μm to about 190 μm, or from about 100 μm to about 190 μm, or from about 110 μm to about 190 μm, or from about 120 μm to about 190 μm, or from about 130 μm to about 190 μm, or from about 140 μm to about 190 μm, or from about 150 μm to about 190 μm, or from about 160 μm to about 190 μm, or from about 170 μm to about 190 μm, or from about 180 μm to about 190 μm, or from about 10 μm to about 180 μm, or from about 20 μm to about 180 μm, or from about 30 μm to about 180 μm, or from about 40 μm to about 180 μm, or from about 50 μm to about 180 μm, or from about 53 μm to about 180 μm, or from about 60 μm to about 180 μm, or from about 70 μm to about 180 μm, or from about 80 μm to about 180 μm, or from about 90 μm to about 180 μm, or from about 100 μm to about 180 μm, or from about 110 μm to about 180 μm, or from about 120 μm to about 180 μm, or from about 130 μm to about 180 μm, or from about 140 μm to about 180 μm, or from about 150 μm to about 180 μm, or from about 160 μm to about 180 μm, or from about 170 μm to about 180 μm, or from about 10 μm to about 170 μm, or from about 20 μm to about 170 μm, or from about 30 μm to about 170 μm, or from about 40 μm to about 170 μm, or from about 50 μm to about 170 μm, or from about 53 μm to about 170 μm, or from about 60 μm to about 170 μm, or from about 70 μm to about 170 μm, or from about 80 μm to about 170 μm, or from about 90 μm to about 170 μm, or from about 100 μm to about 170 μm, or from about 110 μm to about 170 μm, or from about 120 μm to about 170 μm, or from about 130 μm to about 170 μm, or from about 140 μm to about 170 μm, or from about 150 μm to about 170 μm, or from about 160 μm to about 170 μm, or from about 10 μm to about 160 μm, or from about 20 μm to about 160 μm, or from about 30 μm to about 160 μm, or from about 40 μm to about 160 μm, or from about 50 μm to about 160 μm, or from about 53 μm to about 160 μm, or from about 60 μm to about 160 μm, or from about 70 μm to about 160 μm, or from about 80 μm to about 160 μm, or from about 90 μm to about 160 μm, or from about 100 μm to about 160 μm, or from about 110 μm to about 160 μm, or from about 120 μm to about 160 μm, or from about 130 μm to about 160 μm, or from about 140 μm to about 160 μm, or from about 150 μm to about 160 μm, or from about 10 μm to about 150 μm, or from about 20 μm to about 150 μm, or from about 30 μm to about 150 μm, or from about 40 μm to about 150 μm, or from about 50 μm to about 150 μm, or from about 53 μm to about 150 μm, or from about 60 μm to about 150 μm, or from about 70 μm to about 150 μm, or from about 80 μm to about 150 μm, or from about 90 μm to about 150 μm, or from about 100 μm to about 150 μm, or from about 110 μm to about 150 μm, or from about 120 μm to about 150 μm, or from about 130 μm to about 150 μm, or from about 140 μm to about 150 μm, or from about 10 μm to about 140 μm, or from about 20 μm to about 140 μm, or from about 30 μm to about 140 μm, or from about 40 μm to about 140 μm, or from about 50 μm to about 140 μm, or from about 53 μm to about 140 μm, or from about 60 μm to about 140 μm, or from about 70 μm to about 140 μm, or from about 80 μm to about 140 μm, or from about 90 μm to about 140 μm, or from about 100 μm to about 140 μm, or from about 110 μm to about 140 μm, or from about 120 μm to about 140 μm, or from about 140 μm to about 150 μm, or from about 10 μm to about 130 μm, or from about 20 μm to about 130 μm, or from about 30 μm to about 130 μm, or from about 40 μm to about 130 μm, or from about 50 μm to about 130 μm, or from about 53 μm to about 130 μm, or from about 60 μm to about 130 μm, or from about 70 μm to about 130 μm, or from about 80 μm to about 130 μm, or from about 90 μm to about 130 μm, or from about 100 μm to about 130 μm, or from about 110 μm to about 130 μm, or from about 120 μm to about 130 μm, or from about 10 μm to about 120 μm, or from about 20 μm to about 120 μm, or from about 30 μm to about 120 μm, or from about 40 μm to about 120 μm, or from about 50 μm to about 120 μm, or from about 53 μm to about 120 μm, or from about 60 μm to about 120 μm, or from about 70 μm to about 120 μm, or from about 80 μm to about 120 μm, or from about 90 μm to about 120 μm, or from about 100 μm to about 120 μm, or from about 110 μm to about 120 μm, or from about 10 μm to about 110 μm, or from about 20 μm to about 110 μm, or from about 30 μm to about 110 μm, or from about 40 μm to about 110 μm, or from about 50 μm to about 110 μm, or from about 53 μm to about 110 μm, or from about 60 μm to about 110 μm, or from about 70 μm to about 110 μm, or from about 80 μm to about 110 μm, or from about 90 μm to about 110 μm, or from about 100 μm to about 110 μm, or from about 10 μm to about 100 μm, or from about 20 μm to about 100 μm, or from about 30 μm to about 100 μm, or from about 40 μm to about 100 μm, or from about 50 μm to about 100 μm, or from about 53 μm to about 100 μm, or from about 60 μm to about 100 μm, or from about 70 μm to about 100 μm, or from about 80 μm to about 100 μm, or from about 90 μm to about 100 μm, or from about 10 μm to about 90 μm, or from about 20 μm to about 90 μm, or from about 30 μm to about 90 μm, or from about 40 μm to about 90 μm, or from about 50 μm to about 90 μm, or from about 53 μm to about 90 μm, or from about 60 μm to about 90 μm, or from about 70 μm to about 90 μm, or from about 80 μm to about 90 μm, or from about 10 μm to about 80 μm, or from about 20 μm to about 80 μm, or from about 30 μm to about 80 μm, or from about 40 μm to about 80 μm, or from about 50 μm to about 80 μm, or from about 53 μm to about 80 μm, or from about 60 μm to about 80 μm, or from about 70 μm to about 80 μm, or from about 10 μm to about 70 μm, or from about 20 μm to about 70 μm, or from about 30 μm to about 70 μm, or from about 40 μm to about 70 μm, or from about 50 μm to about 70 μm, or from about 53 μm to about 70 μm, or from about 60 μm to about 70 μm, or from about 10 μm to about 60 μm, or from about 20 μm to about 60 μm, or from about 30 μm to about 60 μm, or from about 40 μm to about 60 μm, or from about 50 μm to about 60 μm, or from about 53 μm to about 60 μm, or from about 10 μm to about 53 μm, or from about 20 μm to about 53 μm, or from about 30 μm to about 53 μm, or from about 40 μm to about 53 μm, or from about 50 μm to about 53 μm, or from about 10 μm to about 50 μm, or from about 20 μm to about 50 μm, or from about 30 μm to about 50 μm, or from about 40 μm to about 50 μm, or from about 10 μm to about 40 μm, or from about 20 μm to about 40 μm, or from about 30 μm to about 40 μm, or from about 10 μm to about 30 μm, or from about 20 μm to about 30 μm, or from about 10 μm to about 20 μm.

In another embodiment, elemental copper particles may be mixed with the copper oxide. Thus, in embodiment, the protective material may comprise copper oxide containing compositions which comprise from about 1% to about 65% w/w of elemental copper particles, or from about 10% to about 65% w/w, or from about 20% to about 65% w/w, or from about 30% to about 65% w/w, or from about 40% to about 65% w/w, or from about 50% to about 65% w/w, or from about 60% to about 65% w/w, about 1% to about 60% w/w, or from about 10% to about 60% w/w, or from about 20% to about 60% w/w, or from about 30% to about 60% w/w, or from about 40% to about 60% w/w, or from about 50% to about 60% w/w, about 1% to about 50% w/w, or from about 10% to about 50% w/w, or from about 20% to about 50% w/w, or from about 30% to about 50% w/w, or from about 40% to about 50% w/w, about 1% to about 40% w/w, or from about 10% to about 40% w/w, or from about 20% to about 40% w/w, or from about 30% to about 40% w/w, about 1% to about 30% w/w, or from about 10% to about 30% w/w, or from about 20% to about 30% w/w, about 1% to about 20% w/w of elemental copper particles, or from about 10% to about 20% w/w, about 1% to about 10% w/w of elemental copper particles.

In some embodiments, the protective material also includes any suitable combination of a reducing agent, a lubricating agent, a filler material, a binder and water. Such additional components modify the properties of the protective material to suit specific needs.

An example of such an additional component added to the copper oxide containing composition is graphite particles, for example graphite particles having a size of 300 μm or less, or 275 μm or less, or 250 μm or less, or 225 μm or less, or 200 μm or less, or 175 μm or less, or 150 μm or less, or 125 μm or less, or 100 μm or less, or 75 μm or less, or 50 μm or less, or 25 μm or less, or from about 25 μm to about 300 μm, or from about 50 μm to about 300 μm, or from about 75 μm to about 300 μm, or from about 100 μm to about 300 μm, or from about 150 μm to about 300 μm, or from about 200 μm to about 300 μm, or from about 250 μm to about 300 μm. Graphite acts as a lubricating agent when first spreading the protective layer and, in some embodiments, also acts as a reducing agent to promote the conversion of copper oxide to copper. Therefore, according to some embodiments, the reducing agent may be graphite, lithium aluminium hydride ($LiAlH_4$), diborane sodium borohydride ($NaBH_4$), compounds containing the Fe2+ ion, such as iron(II) sulfate, compounds containing the Sn2+ ion, such as tin(II) chloride, sulfur dioxide (sometimes also used as an oxidizing agent), sulfite compounds, dithionates, e.g. $Na_2S_2O_6$, thiosulfates, e.g. $Na_2S_2O_3$, Iodides, e.g. KI, Cyanides in hydrochemical metallurgical processes, carbon (C) forms distinct from graphite, or combinations thereof.

It should be noted that the reducing agent graphite typically has a relatively small reactivity at room temperature but a relatively large reactivity at the temperature of the electrolyte 20 when electrolysis is performed. In embodiments, the reducing agent may be from about 5 to about 15% w/w, or from about 10 to about 15% w/w, or from about 5 to about 10% w/w of the composition. In embodiments, the graphite may be from about 5 to about 15% w/w, or from about 10 to about 15% w/w, or from about 5 to about 10% w/w of the composition.

Also, according to some embodiments, lubricating agent may be graphite, molybdenum disulfide ($MoS_2$), boron nitrite (BN, h-BN), polytetrafluorethylene (PTFE), or combinations thereof. In embodiments, the lubricating agent may be from about 5 to about 15% w/w, or from about 10 to about 15% w/w, or from about 5 to about 10% w/w of the composition. In embodiments, the graphite may be from about 5 to about 15% w/w, or from about 10 to about 15% w/w, or from about 5 to about 10% w/w of the composition.

According to an embodiment, the copper oxide containing composition may comprise a filler. Examples of a filler material is silicon carbide (SiC), such as SiC particles of various grits, for example between 6 and 150 grit. The filler material is relatively inert and does not react significantly with the electrolyte 20. Other filler materials also include ground calcium carbonate (GCC), precipitated calcium carbonate (PCC), kaolin, talc, Wollastonite (CaSiO3), Silica (Precipitated), glass and carbon black, or combinations thereof. In embodiments, the filler material may be from about 0 to about 25% w/w, or from about 5 to about 25% w/w, or from about 10 to about 25% w/w, or from about 15 to about 25% w/w, or from about 20 to about 25% w/w, or from about 0 to about 20% w/w, or from about 5 to about 20% w/w, or from about 10 to about 20% w/w, or from about 15 to about 20% w/w, or from about 0 to about 15% w/w, or from about 5 to about 15% w/w, or from about 10 to about 15% w/w, or from about 0 to about 10% w/w, or from about 5 to about 10% w/w, or from about 5 to about 10% w/w of the composition. In embodiments, the SiC may be from about 0 to about 25% w/w, or from about 5 to about 25% w/w, or from about 10 to about 25% w/w, or from about 15 to about 25% w/w, or from about 20 to about 25% w/w, or from about 0 to about 20% w/w, or from about 5 to about 20% w/w, or from about 10 to about 20% w/w, or from about 15 to about 20% w/w, or from about 0 to about 15% w/w, or from about 5 to about 15% w/w, or from about 10 to about 15% w/w, or from about 0 to about 10% w/w, or from about 5 to about 10% w/w, or from about 5 to about 10% w/w of the composition.

In embodiments, the filler material may be provided as particles having a particle size of from about 6 to about 150 grit (3350 μm-75 μm), or in SI units from about 75 μm to about 3350 μm, or from about 100 μm to about 3350 μm, or from about 200 μm to about 3350 μm, or from about 300 μm to about 3350 μm, or from about 400 μm to about 3350 μm, or from about 500 μm to about 3350 μm, or from about 600 μm to about 3350 μm, or from about 700 μm to about 3350 μm, or from about 800 μm to about 3350 μm, or from about 900 μm to about 3350 μm, or from about 1000 μm to about 3350 μm, or from about 1500 μm to about 3350 μm, or from about 2000 μm to about 3350 μm, or from about 2500 μm to about 3350 μm, or from about 3000 μm to about 3350 μm, or from about 75 μm to about 3000 μm, or from about 100 μm to about 3000 μm, or from about 200 μm to about 3000 μm, or from about 300 μm to about 3000 μm, or from about 400 μm to about 3000 μm, or from about 500 μm to about 3000 μm, or from about 600 μm to about 3000 μm, or from about 700 μm to about 3000 μm, or from about 800 μm to about 3000 μm, or from about 900 μm to about 3000 μm, or from about 1000 μm to about 3000 μm, or from about 1500 μm to about 3000 μm, or from about 2000 μm to about 3000 μm, or from about 2500 μm to about 3000 μm, or from about 75 μm to about 2500 μm, or from about 100 μm to about 2500 μm, or from about 200 μm to about 2500 μm, or from about 300 μm to about 2500 μm, or from about 400 μm to about 2500 μm, or from about 500 μm to about 2500 μm, or from about 600 μm to about 2500 μm, or from about 700 μm to about 2500 μm, or from about 800 μm to about 2500 μm, or from about 900 μm to about 2500 μm, or from about 1000 μm to about 2500 μm, or from about 1500 μm to about 2500 μm, or from about 2000 μm to about 2500 μm, or from about 75 μm to about 2000 μm, or from about 100 μm to about 2000 μm, or from about 200 μm to about 2000 μm, or from about 300 μm to about 2000 μm, or from about 400 μm to about 2000 μm, or from about 500 μm to about 2000 μm, or from about 600 μm to about 2000 μm, or from about 700 μm to about 2000 μm, or from about 800 μm to about 2000 μm, or from about 900 μm to about 2000 μm, or from about 1000 μm to about 2000 μm, or from about 1500 μm to about 2000 μm, or from about 75 μm to about 1500 μm, or from about 100 μm to about 1500 μm, or from about 200 μm to about 1500 μm, or from about 300 μm to about 1500 μm, or from about 400 μm to about 1500 μm, or from about 500 μm to about 1500 μm, or from about 600 μm to about 1500 μm, or from about 700 μm to about 1500 μm, or from about 800 μm to about 1500 μm, or from about 900 μm to about 1500 μm, or from about 1000 μm to about 1500 μm, or from about 75 μm to about 1000 μm, or from about 100 μm to about 1000 μm, or from about 200 μm to about 1000 μm, or from about 300 μm to about 1000 μm, or from about 400 μm to about 1000 μm, or from about 500 μm to about 1000 μm, or from about 600 μm to about 1000 μm, or from about 700 μm to about 1000 μm, or from about 800 μm to about 1000 μm, or from about 900 μm to about 1000 μm, or from about 75 μm to about 900 μm, or from about 100 μm to about 900 μm, or from about 200 μm to about 900 μm, or from about 300 μm to about 900 μm, or from about 400 μm to about 900 μm, or from about 500 μm to about 900 μm, or from about 600 μm to about 900 μm, or from about 700 μm to about 900 μm, or from about 800 μm to about 900 μm, or from about 75 μm to about 800 μm, or from about 100 μm to about 800 μm, or from about 200 μm to about 800 μm, or from about 300 μm to about 800 μm, or from about 400 μm to about 800 μm, or from about 500 μm to about 800 μm, or from about 600 μm to about 800 μm, or from about 700 μm to about 800 μm, or from about 75 μm to about 700 μm, or from about 100 μm to about 700 μm, or from about 200 μm to about 700 μm, or from about 300 μm to about 700 μm, or from about 400 μm to about 700 μm, or from about 500 μm to about 700 μm, or from about 600 μm to about 700 μm, or from about 75 μm to about 600 μm, or from about 100 μm to about 600 μm, or from about 200 μm to about 600 μm, or from about 300 μm to about 600 μm, or from about 400 μm to about 600 μm, or from about 500 μm to about 600 μm, or from about 75 μm to about 500 μm, or from about 100 μm to about 500 μm, or from about 200 μm to about 500 μm, or from about 300 μm to about 500 μm, or from about 400 μm to about 500 μm, or from about 75 μm to about 400 μm, or from about 100 μm to about 400 μm, or from about 200 μm to about 400 μm, or from about 300 μm to about 400 μm, or from about 75 μm to about 300 μm, or from about 100 μm to about 300 μm, or from about 200 μm to about 300 μm, or from about 75 μm to about 200 μm, or from about 100 μm to about 200 μm, from about 75 μm to about 100 μm.

In another embodiment, the copper oxide containing composition may comprise a binder. Example of binder include bentonite, kaolinite, halloysite, phyrophillite, monmorillonite, or combinations thereof. The bentonite, kaolinite, halloysite, phyrophillite, monmorillonite may form a clay mixture having a Tyler mesh of 325 or more and which is used as a binder. When used, the clay mixture may include, for example, any percentage of bentonite, kaolinite, halloysite, phyrophillite and montmorillonite, for example at about 0 to about 15% w/w, or from about 5 to about 15%, or from about 10 to about 15% w/w, or 0 to about 10% w/w, or from about 5 to about 10% w/w, or 0 to about 5% w/w of the composition. According to another embodiment, the binder may be a colloidal silica. The colloidal silica may be at about 0 to about 15% w/w, or from about 5 to about 15%, or from about 10 to about 15% w/w, or 0 to about 10% w/w, or from about 5 to about 10% w/w, or 0 to about 5% w/w of the composition. According to yet another embodiment, the binder may be a mixture of the above, also used at about 0 to about 15% w/w, or from about 5 to about 15%, or from about 10 to about 15% w/w, or 0 to about 10% w/w, or from about 5 to about 10% w/w, or 0 to about 5% w/w of the composition.

In embodiments, the binder may be provided as particles of a particle size of about 44 μm or smaller, or 40 μm or smaller, or 35 μm or smaller, or 30 μm or smaller, or 25 μm or smaller, or 20 μm or smaller, or 15 μm or smaller, or 10 μm or smaller, or from about 10 μm to about 44 μm, or from about 15 μm to about 44 μm, or from about 20 μm to about 44 μm, or from about 25 μm to about 44 μm, or from about 30 μm to about 44 μm, or from about 35 μm to about 44 μm, or from about 40 μm to about 44 μm, or from about 10 μm to about 40 μm, or from about 15 μm to about 40 μm, or from about 20 μm to about 40 μm, or from about 25 μm to about 40 μm, or from about 30 μm to about 40 μm, or from about 35 μm to about 40 μm, or from about 10 μm to about 35 μm, or from about 15 μm to about 35 μm, or from about 20 μm to about 35 μm, or from about 25 μm to about 35 μm, or from about 30 μm to about 35 μm, or from about 10 μm to about 30 μm, or from about 15 μm to about 30 μm, or from about 20 μm to about 30 μm, or from about 25 μm to about 30 μm, or from about 10 μm to about 25 μm, or from about 15 μm to about 25 μm, or from about 20 μm to about 25 μm, or from about 10 μm to about 20 μm, or from about 15 μm to about 20 μm, or from about 10 μm to about 15 μm.

Water, when added, changes the protective material from a powder to a mortar, paste, slurry or grouting, that can then be spread using common techniques for spreading such materials. The water is in some embodiments distilled water. In other embodiments, the water is tap water.

The following table illustrates examples of embodiments of protective materials in accordance with the invention:

TABLE 1 examples of embodiments of protective materials in accordance with the invention

| Material (wt. %) | Bedding Mix-1 | Bedding Mix-2 | Paste | Mortar -1 | Mortar -2 | Slurry |
|---|---|---|---|---|---|---|
| CuO/Cu2O mixture | 61.07 | 100.00 | 78.94 | 43.77 | 42.12 | 44.64 |
| Graphite (300 μm max) | 9.43 | — | — | 6.76 | 6.51 | 6.89 |
| Sub Total: | 70.50 | 100.00 | 78.94 | 50.53 | 48.62 | 51.53 |
| SiC-Grit-10 | 5.31 | — | — | — | — | — |
| SiC-Grit-16 | 6.99 | — | — | — | — | — |
| SiC-Grit-24 | 0.34 | — | — | — | — | — |
| SiC-Grit-36 | 2.28 | — | — | — | — | — |
| SiC-Grit-54 | 2.45 | — | — | — | — | — |
| SiC-Grit-6 | 5.15 | — | — | — | — | — |
| SiC-Grit-70 | 1.49 | — | — | — | — | — |
| SiC-Grit-150 | — | — | — | 6.03 | 5.80 | 6.15 |
| SiC (−400 Tyler Mesh) | — | — | — | 11.17 | 10.75 | 11.40 |
| Sub Total: | 24.01 | 0.00 | 0.00 | 17.21 | 16.56 | 17.55 |
| Clay mixture (−325 Tyler Mesh) | 5.49 | — | — | 5.88 | 9.44 | 4.02 |
| Colloidal silica (30 to 50 wt. % $SiO_2$) | — | — | 6.28 | — | — | — |
| Distilled water | — | — | 14.78 | — | — | — |
| Tap water | — | — | — | 26.38 | 25.39 | 26.90 |
| Sub Total: | 5.49 | 0.00 | 21.06 | 32.26 | 34.82 | 30.92 |
| Total: | 100 | 100 | 100 | 100 | 100 | 100 |

The next table indicates ranges of w/w % of these components that can form protective material according to the invention. The sum of all w/w % in a given protective material add to 100%.

TABLE 2

Examples of ranges of w/w % of these components that can form protective material according to the invention

| Material | Min % | Max % |
|---|---|---|
| $CuO/Cu_2O$ mixture | 35 | 100 |
| Graphite (300 μm max) | 5 | 15 |
| Sub Total: | — | — |
| SiC-Grit-10 | 0 | 10 |
| SiC-Grit-16 | 0 | 10 |
| SiC-Grit-24 | 0 | 2 |
| SiC-Grit-36 | 0 | 5 |
| SiC-Grit-54 | 0 | 5 |
| SiC-Grit-6 | 0 | 10 |
| SiC-Grit-70 | 0 | 5 |
| SiC-Grit-150 | 0 | 15 |
| SiC (−400 Tyler Mesh) | 0 | 15 |
| Sub Total: | 0 | 25 |

TABLE 2-continued

Examples of ranges of w/w % of these components that can form protective material according to the invention

| Material | Min % | Max % |
|---|---|---|
| Clay mixture (−325 Tyler Mesh) | 0 | 15 |
| Colloidal silica (30 to 50 wt. % SiO2) | 0 | 10 |
| Distilled water | 0 | 20 |
| Tap water | 0 | 50 |

According to an embodiment, the protective layer comprising elemental copper may be formed from the copper oxide containing composition, and it may be a randomly arranged, continuous copper containing ceramic matrix comprising a plurality of continuous copper paths in electrical communication with the refractory material assembly on one side, and the electrolyte on the other side.

According to another embodiment, the elemental copper comprising composite material may be a randomly arranged, continuous copper containing ceramic matrix comprising a plurality of continuous copper paths in electrical communication with the refractory material assembly on one side, and the electrolyte on the other side.

According to another embodiment, there is disclosed a copper oxide containing composition comprising from about 35 to 99% w/w of the copper oxide; and any one of from about 5 to about 15% w/w of a reducing agent, from about 1 to about 10% w/w of a binder, or combinations thereof.

The copper oxide may be CuO, $Cu_2O$, $CuO_2$; $Cu_2O_3$, or a combination thereof. Preferably, the copper oxide may be CuO, $Cu_2O$ or a combination thereof. For example, the copper oxide containing composition may contain between about 35% and about 99% w/w, or from about 40% to about 99% w/w, or from about 45% to about 99% w/w, or from about 50% to about 99% w/w, or from about 55% to about 99% w/w, or from about 60% to about 99% w/w, or from about 65% to about 99% w/w, or from about 70% to about 99% w/w, or from about 75% to about 99% w/w, or from about 80% to about 99% w/w, or from about 85% to about 99% w/w, or from about 90% to about 99% w/w, or from about 95% to about 99% w/w, or about 35% and about 95% w/w, or from about 40% to about 95% w/w, or from about 45% to about 95% w/w, or from about 50% to about 95% w/w, or from about 55% to about 95% w/w, or from about 60% to about 95% w/w, or from about 65% to about 95% w/w, or from about 70% to about 95% w/w, or from about 75% to about 95% w/w, or from about 80% to about 95% w/w, or from about 85% to about 95% w/w, or from about 90% to about 95% w/w, or about 35% and about 90% w/w, or from about 40% to about 90% w/w, or from about 45% to about 90% w/w, or from about 50% to about 90% w/w, or from about 55% to about 90% w/w, or from about 60% to about 90% w/w, or from about 65% to about 90% w/w, or from about 70% to about 90% w/w, or from about 75% to about 90% w/w, or from about 80% to about 90% w/w, or from about 85% to about 90% w/w, or about 35% and about 85% w/w, or from about 40% to about 85% w/w, or from about 45% to about 85% w/w, or from about 50% to about 85% w/w, or from about 55% to about 85% w/w, or from about 60% to about 85% w/w, or from about 65% to about 85% w/w, or from about 70% to about 85% w/w, or from about 75% to about 85% w/w, or from about 80% to about 85% w/w, or about 35% and about 80% w/w, or from about 40% to about 80% w/w, or from about 45% to about 80% w/w, or from about 50% to about 80% w/w, or from about 55% to about 80% w/w, or from about 60% to about 80% w/w, or from about 65% to about 80% w/w, or from about 70% to about 80% w/w, or from about 75% to about 80% w/w, or about 35% and about 75% w/w, or from about 40% to about 75% w/w, or from about 45% to about 75% w/w, or from about 50% to about 75% w/w, or from about 55% to about 75% w/w, or from about 60% to about 75% w/w, or from about 65% to about 75% w/w, or from about 70% to about 75% w/w, or about 35% and about 65% w/w, or from about 40% to about 65% w/w, or from about 45% to about 65% w/w, or from about 50% to about 65% w/w, or from about 55% to about 65% w/w, or from about 60% to about 65% w/w, or from about 65% to about 65% w/w, or about 35% and about 60% w/w, or from about 40% to about 60% w/w, or from about 45% to about 60% w/w, or from about 50% to about 60% w/w, or from about 55% to about 60% w/w, or about 35% and about 55% w/w, or from about 40% to about 55% w/w, or from about 45% to about 55% w/w, or from about 50% to about 55% w/w, or about 35% and about 50% w/w, or from about 40% to about 50% w/w, or from about 45% to about 50% w/w, or about 35% and about 45% w/w, or from about 40% to about 45% w/w, or from about 35% to about 40% w/w of copper oxide, e.g. CuO, $Cu_2O$ or a mixture thereof in any proportion. In other embodiments, the protective materials may include less than 35% w/w copper oxide. For example, one or more other reducible copper containing compound could be mixed with the copper oxide. Examples of other reducible copper containing compounds include copper sulfates such as $CuSO_4(H_2O)_x$ where x is 0 to 5, and which includes cupric sulfate, $CuSO_4$); copper carbonates such as copper(II) carbonate hydroxides [$Cu_3(CO_3)_2(OH)_2$, and $Cu_2CO_3(OH)_2$], copper (II) carbonate [$CuCO_3$], and copper(I) carbonate [$Cu_2CO_3$], and copper phosphates, such as for example Copper(II) phosphate [$Cu_3(PO_4)_2$], Copper(I) phosphate [$Cu_3PO_4$], turquoise [$CuAl_6(PO_4)_4(OH)_8.4H_2O$], cornetite, libethenite, sampleite [$NaCaCu_5(PO_4)_4Cl.5(H_2O)$]. Thus, in embodiment, the protective material may comprise copper oxide containing compositions which comprise between about 35% and about 99% w/w, or from about 40% to about 99% w/w, or from about 45% to about 99% w/w, or from about 50% to about 99% w/w, or from about 55% to about 99% w/w, or from about 60% to about 99% w/w, or from about 65% to about 99% w/w, or from about 70% to about 99% w/w, or from about 75% to about 99% w/w, or from about 80% to about 99% w/w, or from about 85% to about 99% w/w, or from about 90% to about 99% w/w, or from about 95% to about 99% w/w, or about 35% and about 95% w/w, or from about 40% to about 95% w/w, or from about 45% to about 95% w/w, or from about 50% to about 95% w/w, or from about 55% to about 95% w/w, or from about 60% to about 95% w/w, or from about 65% to about 95% w/w, or from about 70% to about 95% w/w, or from about 75% to about 95% w/w, or from about 80% to about 95% w/w, or from about 85% to about 95% w/w, or from about 90% to about 95% w/w, or about 35% and about 90% w/w, or from about 40% to about 90% w/w, or from about 45% to about 90% w/w, or from about 50% to about 90% w/w, or from about 55% to about 90% w/w, or from about 60% to about 90% w/w, or from about 65% to about 90% w/w, or from about 70% to about 90% w/w, or from about 75% to about 90% w/w, or from about 80% to about 90% w/w, or from about 85% to about 90% w/w, or about 35% and about 85% w/w, or from about 40% to about 85% w/w, or from about 45% to about 85% w/w, or from about 50% to about 85% w/w, or from about 55% to about 85% w/w, or from about 60% to about 85% w/w, or from about 65% to about 85% w/w, or from about 70% to about 85% w/w, or from about 75% to about 85% w/w, or from about 80% to about 85% w/w, or about 35% and about 80% w/w, or from about 40% to about 80% w/w, or from about 45% to about 80% w/w, or from about 50% to about 80% w/w, or from about 55% to about 80% w/w, or from about 60% to about 80% w/w, or from about 65% to about 80% w/w, or from about 70% to about 80% w/w, or from about 75% to about 80% w/w, or about 35% and about 75% w/w, or from about 40% to about 75% w/w, or from about 45% to about 75% w/w, or from about 50% to about 75% w/w, or from about 55% to about 75% w/w, or from about 60% to about 75% w/w, or from about 65% to about 75% w/w, or from about 70% to about 75% w/w, or about 35% and about 65% w/w, or from about 40% to about 65% w/w, or from about 45% to about 65% w/w, or from about 50% to about 65% w/w, or from about 55% to about 65% w/w, or from about 60% to about 65% w/w, or from about 65% to about 65% w/w, or about 35% and about 60% w/w, or from about 40% to about 60% w/w, or from about 45% to about 60% w/w, or from about 50% to about 60% w/w, or from about 55% to about 60% w/w, or about 35% and about 55% w/w, or from about 40% to about 55% w/w, or from about 45% to about 55% w/w, or from about 50% to about 55% w/w, or about 35% and about 50% w/w, or from about 40% to about 50% w/w, or from about 45% to about 50% w/w, or about 35% and about 45% w/w, or from about 40% to about 45% w/w, or from about 35% to about 40% w/w of copper oxide and reducible copper containing compound.

In examples of some embodiments, the copper oxide includes CuO, $Cu_2O$, $CuO_2$; $Cu_2O_3$, or combinations thereof, particles having a size smaller than about 270 Tyler mesh (about 53 microns). However, larger and smaller particle sizes are within the scope of the invention, for example particles smaller than 150 μm. Particles may therefore range from about 10 μm to about 200 μm, or from about 20 μm to about 200 μm, or from about 30 μm to about 200 μm, or from about 40 μm to about 200 μm, or from about 50

μm to about 200 μm, or from about 53 μm to about 200 μm, or from about 60 μm to about 200 μm, or from about 70 μm to about 200 μm, or from about 80 μm to about 200 μm, or from about 90 μm to about 200 μm, or from about 100 μm to about 200 μm, or from about 110 μm to about 200 μm, or from about 120 μm to about 200 μm, or from about 130 μm to about 200 μm, or from about 140 μm to about 200 μm, or from about 150 μm to about 200 μm, or from about 160 μm to about 200 μm, or from about 170 μm to about 200 μm, or from about 180 μm to about 200 μm, or from about 190 μm to about 200 μm, or from about 10 μm to about 190 μm, or from about 20 μm to about 190 μm, or from about 30 μm to about 190 μm, or from about 40 μm to about 190 μm, or from about 50 μm to about 190 μm, or from about 53 μm to about 190 μm, or from about 60 μm to about 190 μm, or from about 70 μm to about 190 μm, or from about 80 μm to about 190 μm, or from about 90 μm to about 190 μm, or from about 100 μm to about 190 μm, or from about 110 μm to about 190 μm, or from about 120 μm to about 190 μm, or from about 130 μm to about 190 μm, or from about 140 μm to about 190 μm, or from about 150 μm to about 190 μm, or from about 160 μm to about 190 μm, or from about 170 μm to about 190 μm, or from about 180 μm to about 190 μm, or from about 10 μm to about 180 μm, or from about 20 μm to about 180 μm, or from about 30 μm to about 180 μm, or from about 40 μm to about 180 μm, or from about 50 μm to about 180 μm, or from about 53 μm to about 180 μm, or from about 60 μm to about 180 μm, or from about 70 μm to about 180 μm, or from about 80 μm to about 180 μm, or from about 90 μm to about 180 μm, or from about 100 μm to about 180 μm, or from about 110 μm to about 180 μm, or from about 120 μm to about 180 μm, or from about 130 μm to about 180 μm, or from about 140 μm to about 180 μm, or from about 150 μm to about 180 μm, or from about 160 μm to about 180 μm, or from about 170 μm to about 180 μm, or from about 10 μm to about 170 μm, or from about 20 μm to about 170 μm, or from about 30 μm to about 170 μm, or from about 40 μm to about 170 μm, or from about 50 μm to about 170 μm, or from about 53 μm to about 170 μm, or from about 60 μm to about 170 μm, or from about 70 μm to about 170 μm, or from about 80 μm to about 170 μm, or from about 90 μm to about 170 μm, or from about 100 μm to about 170 μm, or from about 110 μm to about 170 μm, or from about 120 μm to about 170 μm, or from about 130 μm to about 170 μm, or from about 140 μm to about 170 μm, or from about 150 μm to about 170 μm, or from about 160 μm to about 170 μm, or from about 10 μm to about 160 μm, or from about 20 μm to about 160 μm, or from about 30 μm to about 160 μm, or from about 40 μm to about 160 μm, or from about 50 μm to about 160 μm, or from about 53 μm to about 160 μm, or from about 60 μm to about 160 μm, or from about 70 μm to about 160 μm, or from about 80 μm to about 160 μm, or from about 90 μm to about 160 μm, or from about 100 μm to about 160 μm, or from about 110 μm to about 160 μm, or from about 120 μm to about 160 μm, or from about 130 μm to about 160 μm, or from about 140 μm to about 160 μm, or from about 150 μm to about 160 μm, or from about 10 μm to about 150 μm, or from about 20 μm to about 150 μm, or from about 30 μm to about 150 μm, or from about 40 μm to about 150 μm, or from about 50 μm to about 150 μm, or from about 53 μm to about 150 μm, or from about 60 μm to about 150 μm, or from about 70 μm to about 150 μm, or from about 80 μm to about 150 μm, or from about 90 μm to about 150 μm, or from about 100 μm to about 150 μm, or from about 110 μm to about 150 μm, or from about 120 μm to about 150 μm, or from about 130 μm to about 150 μm, or from about 140 μm to about 150 μm, or from about 10 μm to about 140 μm, or from about 20 μm to about 140 μm, or from about 30 μm to about 140 μm, or from about 40 μm to about 140 μm, or from about 50 μm to about 140 μm, or from about 53 μm to about 140 μm, or from about 60 μm to about 140 μm, or from about 70 μm to about 140 μm, or from about 80 μm to about 140 μm, or from about 90 μm to about 140 μm, or from about 100 μm to about 140 μm, or from about 110 μm to about 140 μm, or from about 120 μm to about 140 μm, or from about 140 μm to about 150 μm, or from about 10 μm to about 130 μm, or from about 20 μm to about 130 μm, or from about 30 μm to about 130 μm, or from about 40 μm to about 130 μm, or from about 50 μm to about 130 μm, or from about 53 μm to about 130 μm, or from about 60 μm to about 130 μm, or from about 70 μm to about 130 μm, or from about 80 μm to about 130 μm, or from about 90 μm to about 130 μm, or from about 100 μm to about 130 μm, or from about 110 μm to about 130 μm, or from about 120 μm to about 130 μm, or from about 10 μm to about 120 μm, or from about 20 μm to about 120 μm, or from about 30 μm to about 120 μm, or from about 40 μm to about 120 μm, or from about 50 μm to about 120 μm, or from about 53 μm to about 120 μm, or from about 60 μm to about 120 μm, or from about 70 μm to about 120 μm, or from about 80 μm to about 120 μm, or from about 90 μm to about 120 μm, or from about 100 μm to about 120 μm, or from about 110 μm to about 120 μm, or from about 10 μm to about 110 μm, or from about 20 μm to about 110 μm, or from about 30 μm to about 110 μm, or from about 40 μm to about 110 μm, or from about 50 μm to about 110 μm, or from about 53 μm to about 110 μm, or from about 60 μm to about 110 μm, or from about 70 μm to about 110 μm, or from about 80 μm to about 110 μm, or from about 90 μm to about 110 μm, or from about 100 μm to about 110 μm, or from about 10 μm to about 100 μm, or from about 20 μm to about 100 μm, or from about 30 μm to about 100 μm, or from about 40 μm to about 100 μm, or from about 50 μm to about 100 μm, or from about 53 μm to about 100 μm, or from about 60 μm to about 100 μm, or from about 70 μm to about 100 μm, or from about 80 μm to about 100 μm, or from about 90 μm to about 100 μm, or from about 10 μm to about 90 μm, or from about 20 μm to about 90 μm, or from about 30 μm to about 90 μm, or from about 40 μm to about 90 μm, or from about 50 μm to about 90 μm, or from about 53 μm to about 90 μm, or from about 60 μm to about 90 μm, or from about 70 μm to about 90 μm, or from about 80 μm to about 90 μm, or from about 10 μm to about 80 μm, or from about 20 μm to about 80 μm, or from about 30 μm to about 80 μm, or from about 40 μm to about 80 μm, or from about 50 μm to about 80 μm, or from about 53 μm to about 80 μm, or from about 60 μm to about 80 μm, or from about 70 μm to about 80 μm, or from about 10 μm to about 70 μm, or from about 20 μm to about 70 μm, or from about 30 μm to about 70 μm, or from about 40 μm to about 70 μm, or from about 50 μm to about 70 μm, or from about 53 μm to about 70 μm, or from about 60 μm to about 70 μm, or from about 10 μm to about 60 μm, or from about 20 μm to about 60 μm, or from about 30 μm to about 60 μm, or from about 40 μm to about 60 μm, or from about 50 μm to about 60 μm, or from about 53 μm to about 60 μm, or from about 10 μm to about 53 μm, or from about 20 μm to about 53 μm, or from about 30 μm to about 53 μm, or from about 40 μm to about 53 μm, or from about 50 μm to about 53 μm, or from about 10 μm to about 50 μm, or from about 20 μm to about 50 μm, or from about 30 μm to about 50 μm, or from about 40 μm to about 50 μm, or from about 10 μm to about 40 μm, or from about 20 μm to about 40 μm, or from about 30 μm to about 40 μm, or from about 10 μm to about 30 μm, or from about 20 μm to about 30 μm, or from about 10 μm to about 20 μm.

In another embodiment, elemental copper particles may be mixed with the copper oxide. Thus, in embodiment, the protective material may comprise copper oxide containing compositions which comprise from 1% to about 65% w/w of elemental copper particles, or from about 10% to about 65% w/w, or from about 20% to about 65% w/w, or from about 30% to about 65% w/w, or from about 40% to about 65% w/w, or from about 50% to about 65% w/w, or from about 60% to about 65% w/w, about 1% to about 60% w/w, or from about 10% to about 60% w/w, or from about 20% to about 60% w/w, or from about 30% to about 60% w/w, or from about 40% to about 60% w/w, or from about 50% to about 60% w/w, about 1% to about 50% w/w, or from about 10% to about 50% w/w, or from about 20% to about 50% w/w, or from about 30% to about 50% w/w, or from about 40% to about 50% w/w, about 1% to about 40% w/w, or from about 10% to about 40% w/w, or from about 20% to about 40% w/w, or from about 30% to about 40% w/w, about 1% to about 30% w/w, or from about 10% to about 30% w/w, or from about 20% to about 30% w/w, about 1% to about 20% w/w of elemental copper particles, or from about 10% to about 20% w/w, about 1% to about 10% w/w of elemental copper particles.

In some embodiments, the copper oxide containing composition also includes any suitable combination of a reducing agent, a lubricating agent, a filler material, a binder and water. Such additional components modify the properties of the protective material to suit specific needs.

An example of such an additional component added to the copper oxide containing composition is graphite particles, for example graphite particles having a size 300 μm or less, or 275 μm or less, or 250 μm or less, or 225 μm or less, or 200 μm or less, or 175 μm or less, or 150 μm or less, or 125 μm or less, or 100 μm or less, or 75 μm or less, or 50 μm or less, or 25 μm or less, or from about 25 μm to about 300 μm, or from about 50 μm to about 300 μm, or from about 75 μm to about 300 μm, or from about 100 μm to about 300 μm, or from about 150 μm to about 300 μm, or from about 200 μm to about 300 μm, or from about 250 μm to about 300 μm. Graphite acts as a lubricating agent when first spreading the protective layer and, in some embodiments, also acts as a reducing agent to promote the conversion of copper oxide to copper. Therefore, according to some embodiments, the reducing agent may be graphite, lithium aluminium hydride ($LiAlH_4$), diborane sodium borohydride ($NaBH_4$), compounds containing the Fe2+ ion, such as iron(II) sulfate, compounds containing the Sn2+ ion, such as tin(II) chloride, sulfur dioxide (sometimes also used as an oxidizing agent), sulfite compounds, dithionates, e.g. $Na_2S_2O_6$, thiosulfates, e.g. $Na_2S_2O_3$, Iodides, e.g. KI, Cyanides in hydrochemical metallurgical processes, carbon (C) forms distinct from graphite, or combinations thereof.

It should be noted that the reducing agent graphite typically has a relatively small reactivity at room temperature but a relatively large reactivity at the temperature of the electrolyte 20 when electrolysis is performed. In embodiments, the reducing agent may be from about 5 to about 15% w/w, or from about 10 to about 15% w/w, or from about 5 to about 10% w/w of the composition. In embodiments, the graphite may be from about 5 to about 15% w/w, or from about 10 to about 15% w/w, or from about 5 to about 10% w/w of the composition.

Also, according to some embodiments, lubricating agent may be graphite, molybdenum disulfide ($MoS_2$), boron nitrite (BN, h-BN), polytetrafluorethylene (PTFE), or combinations thereof. In embodiments, the lubricating agent may be from about 5 to about 15% w/w, or from about 10 to about 15% w/w, or from about 5 to about 10% w/w of the composition. In embodiments, the graphite may be from about 5 to about 15% w/w, or from about 10 to about 15% w/w, or from about 5 to about 10% w/w of the composition.

According to an embodiment, the copper oxide containing composition may comprise a filler. Examples of a filler material is silicon carbide (SiC), such as SiC particles of various grits, for example between 6 and 150 grit. The filler material is relatively inert and does not react significantly with the electrolyte 20. Other filler materials also include include ground calcium carbonate (GCC), precipitated calcium carbonate (PCC), kaolin, talc, Wollastonite ($CaSiO_3$), Silica (Precipitated), glass and carbon black, or combinations thereof. In embodiments, the filler material may be from about 0 to about 25% w/w, or from about 5 to about 25% w/w, or from about 10 to about 25% w/w, or from about 15 to about 25% w/w, or from about 20 to about 25% w/w, or from about 0 to about 20% w/w, or from about 5 to about 20% w/w, or from about 10 to about 20% w/w, or from about 15 to about 20% w/w, or from about 0 to about 15% w/w, or from about 5 to about 15% w/w, or from about 10 to about 15% w/w, or from about 0 to about 10% w/w, or from about 5 to about 10% w/w, or from about 5 to about 10% w/w of the composition. In embodiments, the SiC may be from about 0 to about 25% w/w, or from about 5 to about 25% w/w, or from about 10 to about 25% w/w, or from about 15 to about 25% w/w, or from about 20 to about 25% w/w, or from about 0 to about 20% w/w, or from about 5 to about 20% w/w, or from about 10 to about 20% w/w, or from about 15 to about 20% w/w, or from about 0 to about 15% w/w, or from about 5 to about 15% w/w, or from about 10 to about 15% w/w, or from about 0 to about 10% w/w, or from about 5 to about 10% w/w, or from about 5 to about 10% w/w of the composition.

In embodiments, the filler material may be provided as particles having a particle size of from about 6 to about 150 grit (3350 μm-75 μm), or in SI units from about 75 μm to about 3350 μm, or from about 100 μm to about 3350 μm, or from about 200 μm to about 3350 μm, or from about 300 μm to about 3350 μm, or from about 400 μm to about 3350 μm, or from about 500 μm to about 3350 μm, or from about 600 μm to about 3350 μm, or from about 700 μm to about 3350 μm, or from about 800 μm to about 3350 μm, or from about 900 μm to about 3350 μm, or from about 1000 μm to about 3350 μm, or from about 1500 μm to about 3350 μm, or from about 2000 μm to about 3350 μm, or from about 2500 μm to about 3350 μm, or from about 3000 μm to about 3350 μm, or from about 75 μm to about 3000 μm, or from about 100 μm to about 3000 μm, or from about 200 μm to about 3000 μm, or from about 300 μm to about 3000 μm, or from about 400 μm to about 3000 μm, or from about 500 μm to about 3000 μm, or from about 600 μm to about 3000 μm, or from about 700 μm to about 3000 μm, or from about 800 μm to about 3000 μm, or from about 900 μm to about 3000 μm, or from about 1000 μm to about 3000 μm, or from about 1500 μm to about 3000 μm, or from about 2000 μm to about 3000 μm, or from about 2500 μm to about 3000 μm, or from about 75 μm to about 2500 μm, or from about 100 μm to about 2500 μm, or from about 200 μm to about 2500 μm, or from about 300 μm to about 2500 μm, or from about 400 μm to about 2500 μm, or from about 500 μm to about 2500 μm, or from about 600 μm to about 2500 μm, or from about 700 μm to about 2500 μm, or from about 800 μm to about 2500 μm, or from about 900 μm to about 2500 μm, or from about 1000 μm to about 2500 μm, or from about 1500 μm to about 2500 μm, or from about 2000 μm to about 2500 μm, or from about 75 μm to about 2000 μm, or from about 100 μm to about 2000 μm, or from about 200 μm to about 2000 μm, or from about 300 μm to about 2000 μm, or from about 400 μm to about 2000 μm, or from about 500 μm to about 2000 μm, or from about 600 μm to about 2000 μm, or from about 700 μm to about 2000 μm, or from about 800 μm to about 2000 μm, or from about 900 μm to about 2000 μm, or from about 1000 μm to about 2000 μm, or from about 1500 μm to about 2000 μm, or from about 75 μm to about 1500 μm, or from about 100 μm to about 1500 μm, or from about 200 μm to about 1500 μm, or from about 300 μm to about 1500 μm, or from about 400 μm to about 1500 μm, or from about 500 μm to about 1500 μm, or from about 600 μm to about 1500 μm, or from about 700 μm to about 1500 μm, or from about 800 μm to about 1500 μm, or from about 900 μm to about 1500 μm, or from about 1000 μm to about 1500 μm, or from about 75 μm to about 1000 μm, or from about 100 μm to about 1000 μm, or from about 200 μm to about 1000 μm, or from about 300 μm to about 1000 μm, or from about 400 μm to about 1000 μm, or from about 500 μm to about 1000 μm, or from about 600 μm to about 1000 μm, or from about 700 μm to about 1000 μm, or from about 800 μm to about 1000 μm, or from about 900 μm to about 1000 μm, or from about 75 μm to about 900 μm, or from about 100 μm to about 900 μm, or from about 200 μm to about 900 μm, or from about 300 μm to about 900 μm, or from about 400 μm to about 900 μm, or from about 500 μm to about 900 μm, or from about 600 μm to about 900 μm, or from about 700 μm to about 900 μm, or from about 800 μm to about 900 μm, or from about 75 μm to about 800 μm, or from about 100 μm to about 800 μm, or from about 200 μm to about 800 μm, or from about 300 μm to about 800 μm, or from about 400 μm to about 800 μm, or from about 500 μm to about 800 μm, or from about 600 μm to about 800 μm, or from about 700 μm to about 800 μm, or from about 75 μm to about 700 μm, or from about 100 μm to about 700 μm, or from about 200 μm to about 700 μm, or from about 300 μm to about 700 μm, or from about 400 μm to about 700 μm, or from about 500 μm to about 700 μm, or from about 600 μm to about 700 μm, or from about 75 μm to about 600 μm, or from about 100 μm to about 600 μm, or from about 200 μm to about 600 μm, or from about 300 μm to about 600 μm, or from about 400 μm to about 600 μm, or from about 500 μm to about 600 μm, or from about 75 μm to about 500 μm, or from about 100 μm to about 500 μm, or from about 200 μm to about 500 μm, or from about 300 μm to about 500 μm, or from about 400 μm to about 500 μm, or from about 75 μm to about 400 μm, or from about 100 μm to about 400 μm, or from about 200 μm to about 400 μm, or from about 300 μm to about 400 μm, or from about 75 μm to about 300 μm, or from about 100 μm to about 300 μm, or from about 200 μm to about 300 μm, or from about 75 μm to about 200 μm, or from about 100 μm to about 200 μm, from about 75 μm to about 100 μm.

In another embodiment, the copper oxide containing composition may comprise a binder. Example of binder include bentonite, kaolinite, halloysite, phyrophillite, monmorillonite, or combinations thereof. The bentonite, kaolinite, halloysite, phyrophillite, monmorillonite may form a clay mixture having a Tyler mesh of 325 or more and which is used as a binder. When used, the clay mixture may include, for example, any percentage of bentonite, kaolinite, halloysite, phyrophillite and montmorillonite, for example at about 0 to about 15% w/w, or from about 5 to about 15%, or from about 10 to about 15% w/w, or 0 to about 10% w/w, or from about 5 to about 10% w/w, or 0 to about 5% w/w of the composition. According to another embodiment, the binder may be colloidal silica. The colloidal silica may be at about 0 to about 15% w/w, or from about 5 to about 15%, or from about 10 to about 15% w/w, or 0 to about 10% w/w, or from about 5 to about 10% w/w, or 0 to about 5% w/w of the composition. According to yet another embodiment, the binder may be a mixture of the above, also used at about 0 to about 15% w/w, or from about 5 to about 15%, or from about 10 to about 15% w/w, or 0 to about 10% w/w, or from about 5 to about 10% w/w, or 0 to about 5% w/w of the composition.

In embodiments, the binder may be provided as particles of a particle size of about 44 μm or smaller, or 40 μm or smaller, or 35 μm or smaller, or 30 μm or smaller, or 25 μm or smaller, or 20 μm or smaller, or 15 μm or smaller, or 10 μm or smaller, or from about 10 μm to about 44 μm, or from about 15 μm to about 44 μm, or from about 20 μm to about 44 μm, or from about 25 μm to about 44 μm, or from about 30 μm to about 44 μm, or from about 35 μm to about 44 μm, or from about 40 μm to about 44 μm, or from about 10 μm to about 40 μm, or from about 15 μm to about 40 μm, or from about 20 μm to about 40 μm, or from about 25 μm to about 40 μm, or from about 30 μm to about 40 μm, or from about 35 μm to about 40 μm, or from about 10 μm to about 35 μm, or from about 15 μm to about 35 μm, or from about 20 μm to about 35 μm, or from about 25 μm to about 35 μm, or from about 30 μm to about 35 μm, or from about 10 μm to about 30 μm, or from about 15 μm to about 30 μm, or from about 20 μm to about 30 μm, or from about 25 μm to about 30 μm, or from about 10 μm to about 25 μm, or from about 15 μm to about 25 μm, or from about 20 μm to about 25 μm, or from about 10 μm to about 20 μm, or from about 15 μm to about 20 μm, or from about 10 μm to about 15 μm.

Water, when added, changes the protective material from a powder to a mortar, paste, slurry or grouting, that can then be spread using common techniques for spreading such materials. The water is in some embodiments distilled water. In other embodiments, the water is tap water.

In embodiments, the copper oxide containing composition may be in powder form, paste form, mortar form, slurry form, grouting form, or combinations thereof.

According to another embodiment, there is also provided a method for protecting refractory materials covering the interior surface of an electrolytic cell. The method comprises covering at least in part the refractory materials with a protective layera copper sheet, a structure comprising elemental copper, a copper oxide, an elemental copper comprising composite material, a copper oxide containing composition and combinations thereof, to provide a protective layer comprising elemental copper. The copper oxide containing composition may be a copper oxide containing composition according to the present invention as described above. In embodiments, the layer is applied to the refractory materials prior to filling the electrolytic cell with an electrolyte. Then, the electrolytic cell can be filled with a suitable electrolyte, for example a cryolite containing electrolyte and heated to a suitable temperature at which the cryolite becomes liquid. The method can also include converting the copper containing material (the copper oxide, the elemental copper comprising composite material, the copper oxide containing composition and combinations thereof) to elemental copper. For example, the copper containing material includes any of the above-described protective materials. The thickness of the protective material applied is for example from about 1 to 6.5 mm, but smaller or larger thicknesses are within the scope of the invention. Conversion to elemental copper is performed by reducing the copper containing material with the electrolyte and/or its vapor (including sodium gas), which will diffuse in and/or infiltrate the copper containing compound. The protective layer comprising elemental copper formed comprises a randomly arranged, continuous copper containing ceramic matrix comprising a plurality of continuous copper paths in electrical communication with the refractory material assembly on one side, and the electrolyte on the other side. In embodiments, the elemental copper comprising composite material is a randomly arranged, continuous copper containing ceramic matrix comprising a plurality of continuous copper paths in electrical communication with the refractory material assembly on one side and the electrolyte on the other side.

In another aspect, the proposed protective materials are used to protect anode studs from corrosion by molten cryolithic bath. Anode studs are currently made from iron alloys. To that effect, the anode studs, which support the anodes immersed in the cryolithic bath, are covered by the protective material prior to immersion of the anode 24 in the cryolithic bath.

Figure 6:
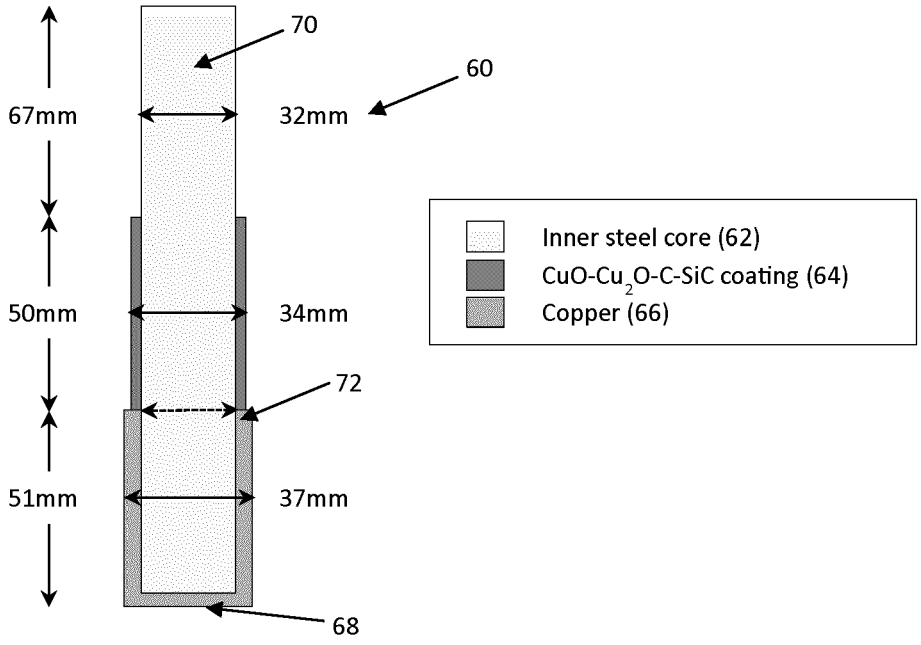
FIG. 6 is a schematic representation of an inert anode assembly according to an embodiment of the present invention.

Now referring to FIG. 6, in embodiments, an inert anode (60) for aluminum reduction cell may be manufactured by covering part of a metal, such as iron, with a protective layer comprising elemental copper according to the present invention and using the partially covered metal as the anode directly, the uncovered part of the metal being directly exposed to the electrolyte. Therefore, in embodiments, there is disclosed an inert anode assembly (60) comprising an inner electrically conducive core (62) comprising a first end (68) coated with a first coating (66) comprising an elemental copper coating, a structure comprising elemental copper, a copper oxide, an elemental copper comprising composite material, a copper oxide containing composition, and combinations thereof, the first end configured to contact a cryolitic bath, and a second end (70), configured to be electrically joined to a current source. In embodiments, the copper oxide containing composition may be a copper oxide containing composition of the present invention. In embodiments, the electrically conducive core may be a metallic core, such as a steel core.

In embodiments, the inert anode (60) may further comprise a second coating (64), coating the inner electrically conducive core (62) over a region (72) of the inner metallic core adjacent (represented by the dashed double arrow) to the first coating. In embodiments, the electrically conducive core (62) is an iron core. In embodiments, the first coating (66) is an elemental copper coating.

In another aspect, it has unexpectedly been found that a thin copper plate (<2 mm), when exposed to an oxidizing atmosphere at temperature between about 900° C. to about 1050° C., converts to a dense copper oxide (CuO and/or $Cu_2O$) ceramic plate. The latter, when heated in this same temperature range, but under a reducing atmosphere, reversibly converts to its original metallic form. When a thin copper plate or a thin copper oxide plate is exposed to an oxygen partial pressure gradient, the interface between the converted and unconverted parts of the plate is cohesive and free from any structural defects.

This suggests a method for manufacturing a copper oxide ceramic, comprising exposing a copper blank in an oxidizing atmosphere at a temperature between about 900° C. to about 1050° C. for a duration sufficient to convert substantially all the copper to copper oxide. For example, the duration is between 4 hours and 24 hours for a copper blank having a thickness of between about 1 mm and about 3 mm. However, other durations and thicknesses are within the scope of the invention.

The present invention will be more readily understood by referring to the following examples which are given to illustrate the invention rather than to limit its scope.

Example 1

Conversion of Copper Oxide to Copper

Figure 2A:
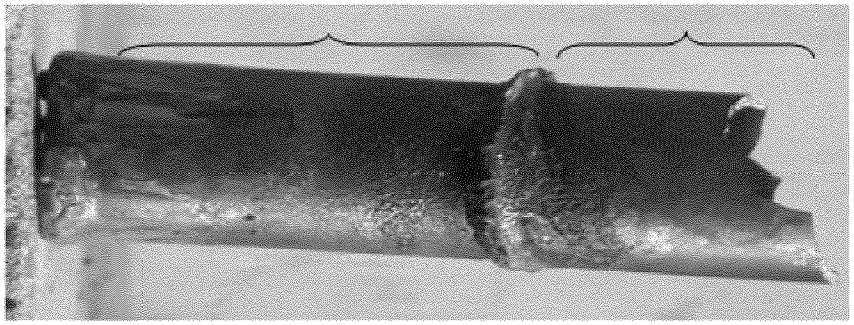
FIG. 2A, in a photograph, illustrates a copper pipe that has been partially immersed in cryolite at 970° C.
Figure 2B:
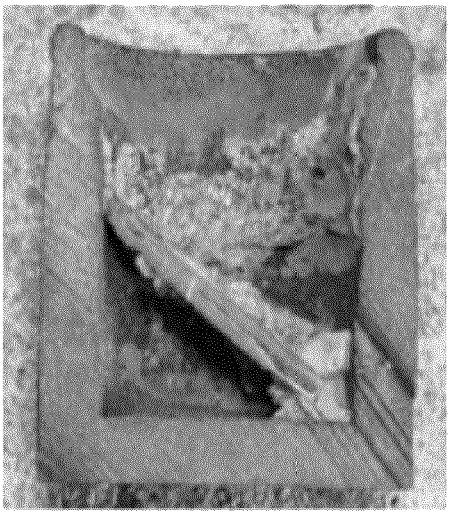
FIG. 2B, in a photograph, illustrates part of the copper pipe of FIG. 2A that had been transformed to copper oxide after being in contact with cryolite vapors and air mixture reverting back to copper after immersion in cryolite at 970° C.

A 2 mm thick copper pipe was partially immersed in a cryolite-based electrolytic bath (eutectic $NaF/Na_3AlF_6$) at 970° C. for 21 hours. The part of the pipe outside the bath (upper bracket) was converted to copper oxide (due to the presence of air into the molten bath vapor), while the portion that was in the bath (lower bracket) remained intact as elemental copper, as seen in FIG. 2A. Porosity measurements using the Archimedes method showed that the copper oxide was essentially containing no open pores. After drying at 110° C., the copper oxide portion was immersed in the same electrolytic bath for 13.5 hours, which caused its conversion back to elemental copper (FIG. 2B).

Example 2

Corrosion of $SiO_2$-based bricks

Figure 3A:
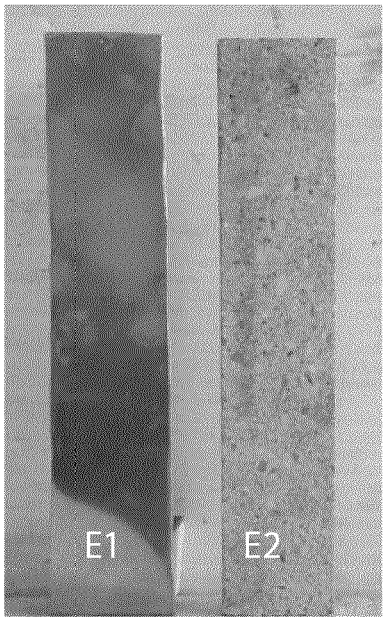
FIG. 3A, in a photograph, illustrates a copper plate and a $SiO_2$-based brick prior to partial immersion in cryolite at 970° C.
Figure 3B:
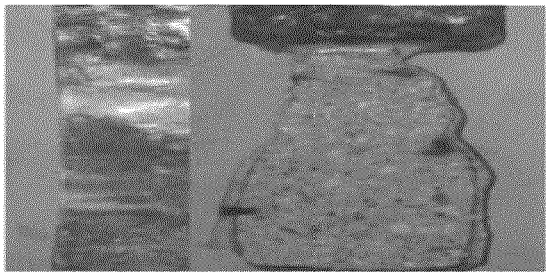
FIG. 3B, in a photograph, illustrates the copper plate and $SiO_2$-based brick of FIG. 3A after partial immersion in cryolite at 970° C.

A 0.88 mm thick copper plate (E1 in FIG. 3A) and a 13.57 mm thick 80% $SiO_2$ brick (E2 in FIG. 3A) were immersed in a cryolite-based electrolytic bath (eutectic $NaF/Na_3AlF_6$) at 970° C. for 20 hours. FIG. 3B shows that the copper plate remained essentially intact, with the portion above the bath converted to bulk solid copper oxide, while the brick was dissolved, especially at the bath/atmosphere interface. The brick was also vitrified at this interface and below the bath line.

Example 3

Protection of $SiO_2$-Based Bricks

The following setup was assembled. In a graphite crucible 100, two assemblies 102 and 104 were mounted in graphite powder 106. The second assembly 104 included 80% $SiO_2$ bricks 108 defining a chamber 110 partially filled with an eutectic $NaF/Na_3AlF_6$ solution 112, which also contained a small amount (5 w/w %) of $CaF_2$ (a currently used additive to modify the property of the electrolyte in industrial aluminum reduction cells). The first assembly 102 was similar to the second assembly 104, except that it included two parallel copper sheets 114, below and above the chamber 110, extending laterally along the whole first assembly 102. Alumina bricks 116 were provided above the graphite crucible 100. The copper sheets 114 were bound to the bricks 108 through thermal treatment with air heated at 970° C.

Figure 4A:
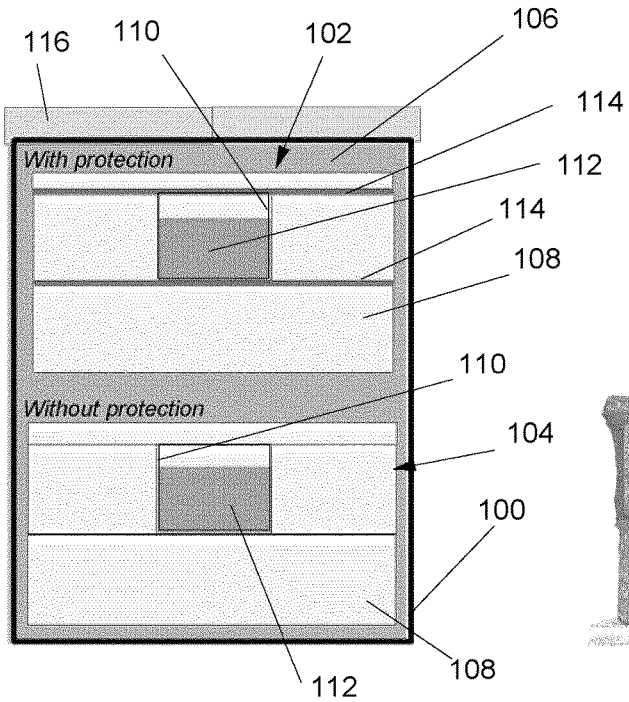
FIG. 4A, in a schematic view, illustrates an experimental setup for assessing protection of $SiO_2$-based brick from cryolite by copper.
Figure 4B:
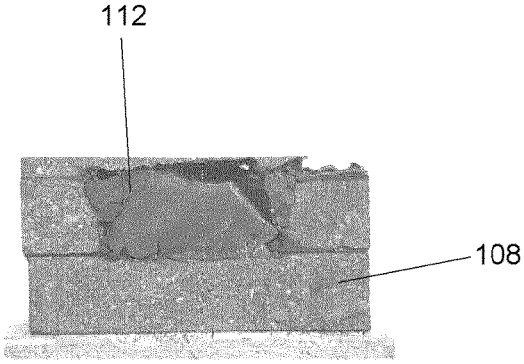
FIG. 4B, in a photograph, illustrates the result of heating under vapor of cryolitic bath a portion of the setup of FIG. 4A that did not include the protective copper.
Figure 4C:
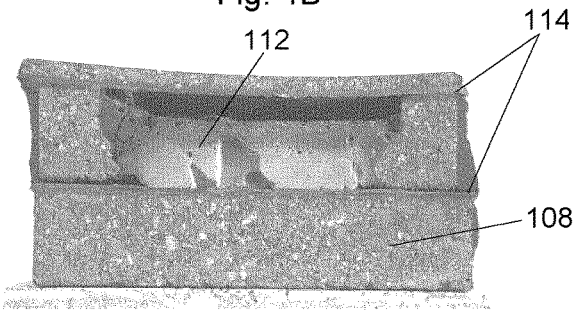
FIG. 4C, in a photograph, illustrates the result of heating under vapor of cryolitic bath a portion of the setup of FIG. 4A that included the protective copper.

The setup was then inserted in a furnace pre-heated at 560° C. The furnace was maintained at this temperature for one hour, after which the temperature of the furnace was raised to 1000° C. in 2.5 hour and maintained at this temperature for 20 hours. Subsequently, the temperature of the furnace was lowered to 750° C. at a rate of 195° C./hr, after which the furnace was opened. The setup was removed from the furnace when the furnace temperature had further dropped to 650° C. FIGS. 4B and 4C illustrate respectively the 80% $SiO_2$ bricks without and with copper plate protection. In FIG. 4B, it is clearly seen that the molten bath and its vapors dissolved the brick, while FIG. 4C shows that the bricks above and below the molten bath were protected by the copper sheets 114. The bricks that were not protected by the copper sheets 114, i.e. the bricks positioned beside the molten bath, show evidence of damage.

Example 4

Binding Vermiculite, $SiO_2$-Based Brick and Copper Sheet

A 0.8 mm thick copper sheet was positioned between a vermiculite panel and an 80% $SiO_2$ brick. A static load of a few kilograms was applied on the whole assembly, which was then heated in air from room temperature up to 970° C. in a furnace at a rate of 10° C./min, maintained at 970° C. for 5 hours and then cooled down at a rate of 10° C./min. The whole assembly was bound together by this process and the copper plate adhered to both the vermiculite panel and the $SiO_2$ brick.

Example 5

Binding Calcium Silicate Panel, $SiO_2$-Based Brick and Copper Sheet

The protocol of example 4 was repeated with the vermiculite panel replaced by a calcium silicate panel. Similar results, i.e. binding of the materials to copper, were observed.

Example 6

Copper Protection of a $SiO_2$-Based Brick

Figure 5:
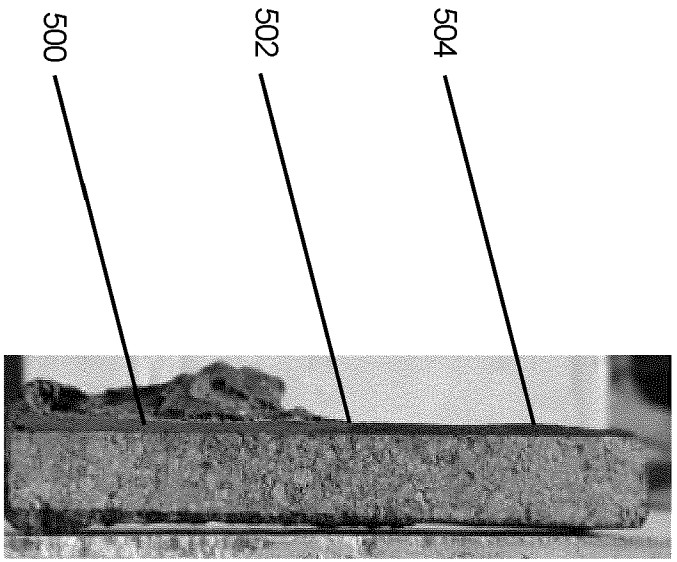
FIG. 5, in a photograph, illustrates conversion to copper of a copper oxide layer covering a $SiO_2$-based brick when immersed in cryolite at 970° C.

The protective material identified as "Mortar-2" above was used to coat a rod made by cutting a 80% w/w $SiO_2$ brick. The coating had a thickness of about 6-6.5 mm. The coated rod was dried at 110° C. for 10 hours and then fired in graphite powder in a furnace at 675° C. for one hour, after which the temperature was increased to 970° C. The furnace was stopped and the bar was removed therefrom and immersed partially in an eutectic $NaF/Na_3AlF_6$ bath, which also contained 5% w/w $CaF_2$, for 4 hours. As shown in FIG. 5, the portion of the bar that was maintained above the bath (upper part of the bar in FIG. 5) remained covered with the Mortar-2 composition, which protected the underlying $SiO_2$ brick from corrosion. The portion of the bar that was immersed in the bath ended up covered with a continuous and uniform copper layer 500. At the interface 502 between the two above-described zones, a transition 504 that remained continuous is observed.

Example 7

Copper Protection of a Steel-Based Inert Anode

Carbone anodes are traditionally used in aluminum electrolytic cells for producing aluminum according to the following reaction:

$$Al_2O_3\text{ (dissolved into cryolitic bath)}+3/2C\text{ (carbone anode)}\rightarrow 2Al\text{ (liq)}+3/2CO_2(g) \quad \text{(Reaction 1)}$$

Carbone anodes are thus consumed during electrolysis. Several materials have been proposed for making inert anodes for the Hall-Héroult process. These materials mostly include ceramics and cermets. What limit the use of such materials as inert anodes is either their too high solubility into cryolitic bath at 1050° C. or their too low electrical conductivity at that temperature, or both. Metals can generally not be used since alumina electrolysis with inert anodes promotes the liberation of oxygen gas according to the following reaction:

$$Al_2O_3\text{ (dissolved into cryolitic bath)}\rightarrow 2Al\text{ (liq)}+3/2O_2(g) \quad \text{(Reaction 2)}$$

At 1050° C., most metals convert to electrical nonconductive oxides in presence of cryolithic bath vapor. In case of copper, the nature of its oxides varies with respect to oxygen partial pressure as follow:

(Reaction 3)

$$\text{Cu (s)} + \underset{\text{Low } PO_2}{O_2\text{ (g)}} \longrightarrow \underset{\text{moderate } PO_2}{Cu_{2-x}O\text{ (s)}} \longrightarrow \underset{\text{High } PO_2}{CuO_{1-x}\text{ (s)}} \longrightarrow \text{CuO (s)}$$

Both $Cu_{2-x}O$ and $CuO_{1-x}$ are intrinsic semiconductor, type-p and type-n, respectively. Unlike these oxydes, CuO is dielectric (electrical insulator). However, it is believed that in presence of cryolitic bath vapor, CuO can be doped with fluorine to form an extrinsic copper oxifluoride type-n semiconductor, according to the following reaction:

$$CuO(s)+(x/2)CuF_2(s)\rightarrow CuO_{1-x}F_x(s) \quad \text{(Reaction 4)}$$

where $CuF_2$ would be produced from the following reaction:

$$CuO+F_2(g)\rightarrow CuF_2(s)+0.5O_2(g)(\Delta Go=-317KJ/MoI\ CuO) \quad \text{(Reaction 5)}$$

As a massive anode, copper cannot be used because of its too low melting temperature (1085° C.) promoting it's flowing at 1050° C. The purpose of the first conducted electrolysis test was to verify if copper as a thin coating on the surface of a massive steel material can be used as an inert anode assembly in Hall-Héroult cells.

Figure 7:
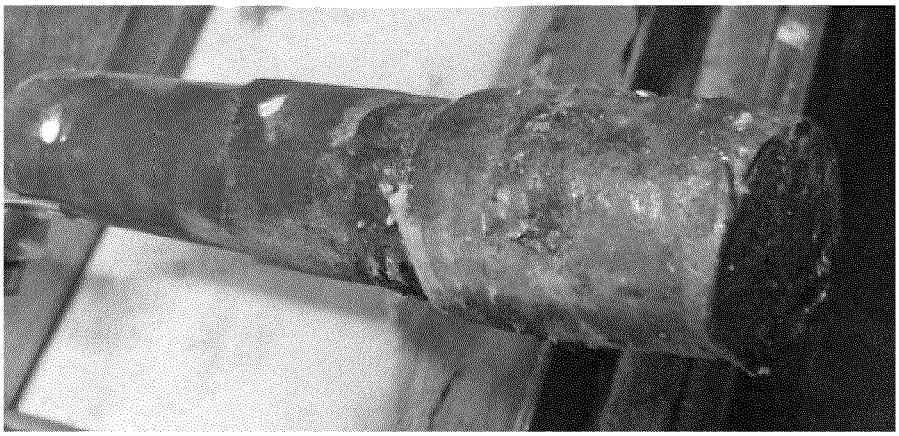
FIG. 7 illustrates the appearance of an inert anode assembly according to an embodiment of the present invention prior to the electrolysis test.

Inert Anode Fabrication Procedure:

A middle steel rod was partially diped into liquid copper at 1150° C. After cooling, a CuO—$Cu_2O$—C—SiC slurry was applied by paint brushing in the central zone of the rod above the copper layer (see FIG. 6). The anode assembly was then dried at 110° C. The appearance of the anode assembly prior to the electrolysis test is shown on FIG. 7.

Test Procedure

Figure 8:
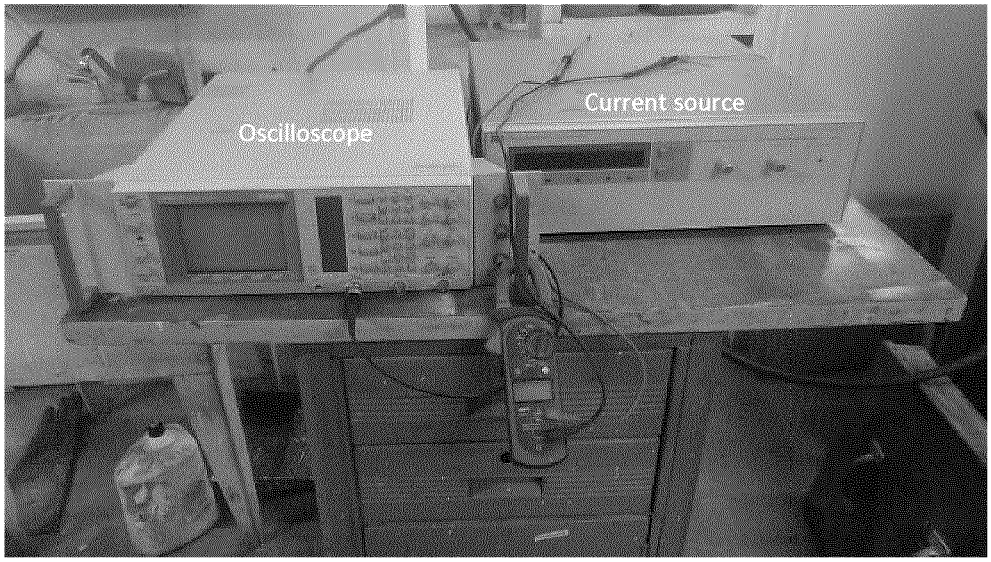
FIG. 8 illustrates the experimental setup used in example 7.
Figure 8:
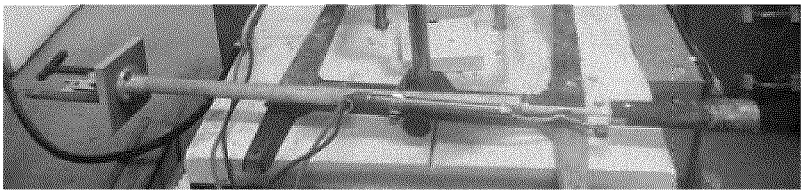
Figure 8:
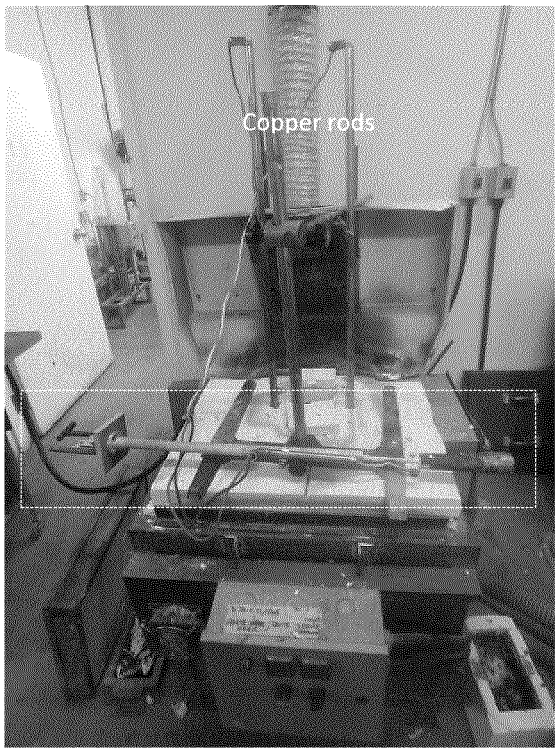
Figure 9:
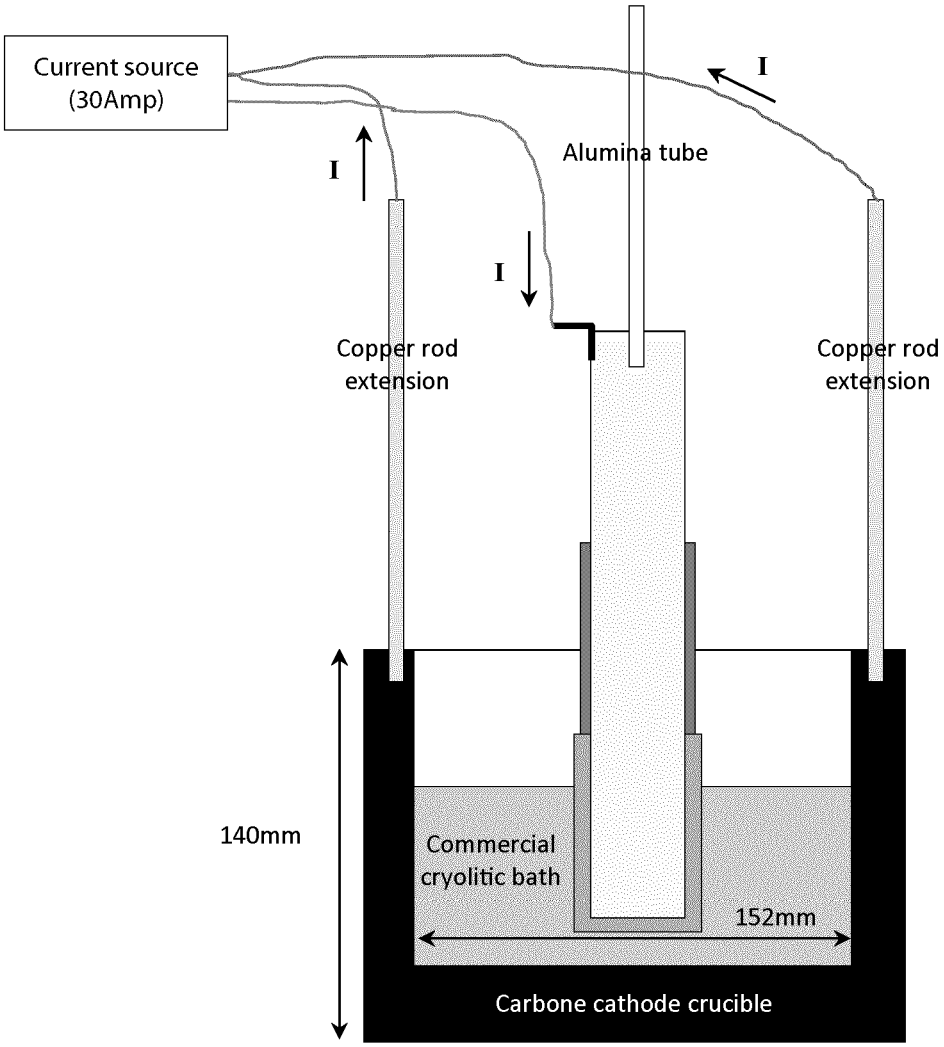
FIG. 9 is a schematic representation of the electrolysis cell used in example 7.
Figure 10:
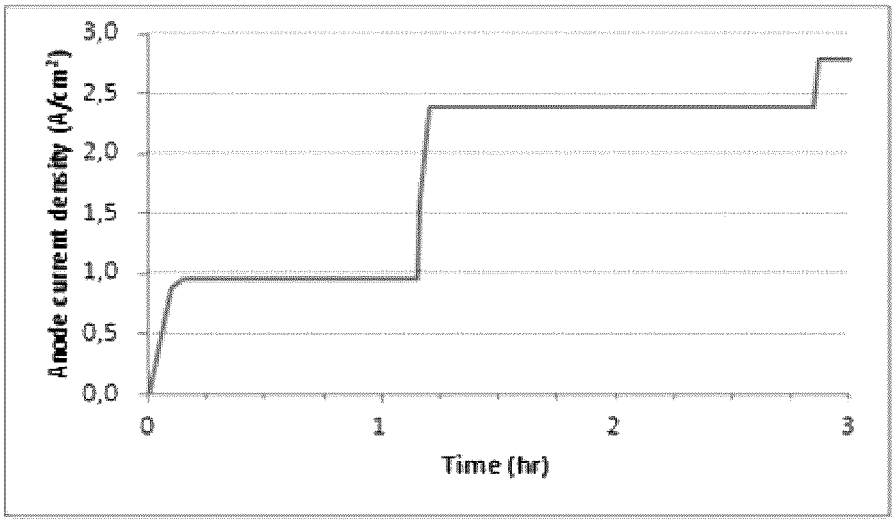
FIG. 10 illustrates the imposed anode current density during the electrolysis test.

The electrolysis test was conducted at 1050° C. with the set-up shown on FIG. 8 and the electrolysis cell presented on FIG. 9. Alumina electrolysis was conducted during 3 hours at an imposed anode current density varying up to 3 $A/cm^2$ according to FIG. 10. During the test, the cell's voltage and electrical resistance were collected. The anode-cathode distance (ACD) was maintained to 11.5 mm during the test.

Test Results

Figure 11:
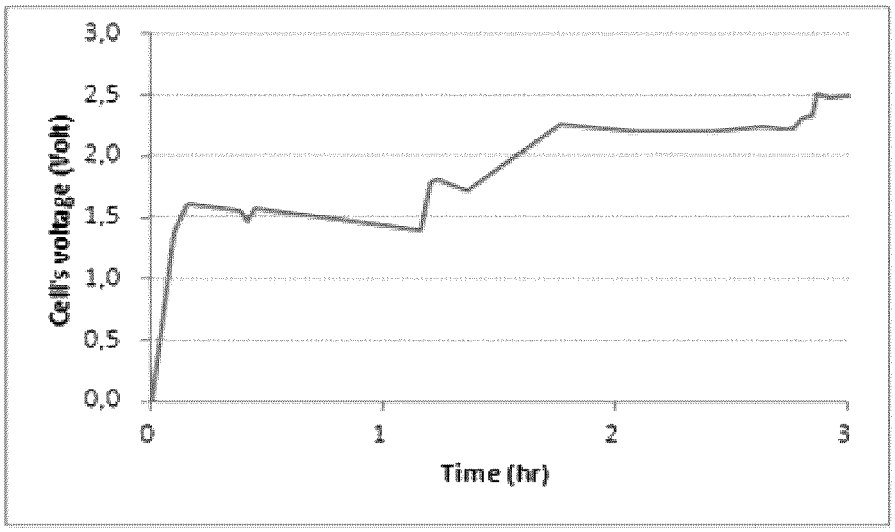
FIG. 11 illustrates the cell's voltage variation during the electrolysis test.
Figure 12:
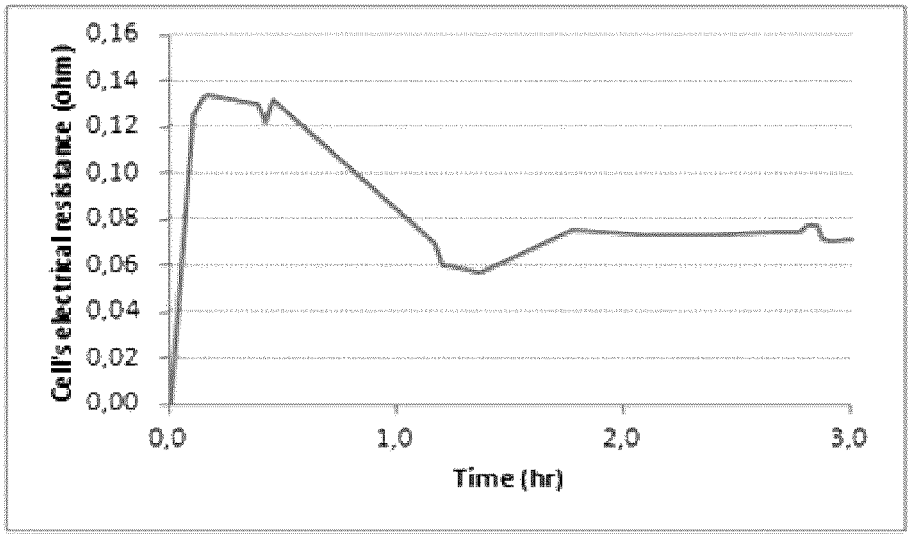
FIG. 12 illustrates the cell's resistance variation during the electrolysis test.

The cell's voltage and electrical resistance variation during the test were as shown on FIGS. 11 and 12, respectively. A low and almost constant electrical resistance was observed during the last hour of the test which suggests that doped copper oxifluoride was formed (FIG. 12).

Figure 13:
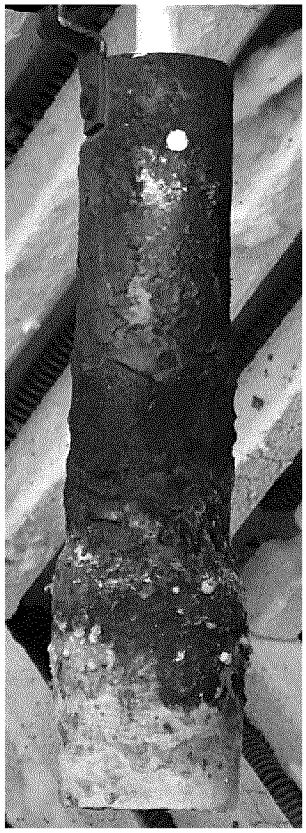
FIG. 13 illustrates the appearance of the inert anode assembly of the present invention after the test.

At the end of the test, a 20 g solidified metal piece was recovered at the bottom of the carbon cathode crucible. The metal appearance was suggesting the presence of metallic copper. Based on density measurements, the amount of aluminum metal contained in the metallic piece was found to be 7 g. Thus, excess copper from the anode coating flowed during the test, as shown on FIG. 13 in comparison with FIG. 7.

Figure 14:
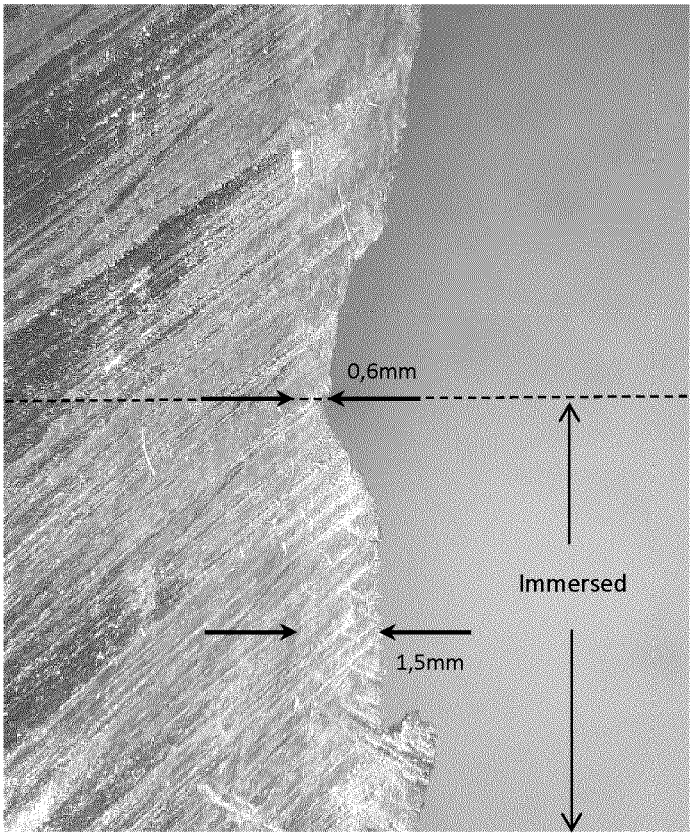
FIG. 14 illustrates a cut section of the inert anode assembly of the present invention after the test.

A cross section of the tested anode assembly was observed under microscope (FIG. 14). No sign of corrosion of the steel rod was detected above and below the bath line where the residual coating thickness was up to about 1.5 mm. The rod was even protected at the bath line (worst corrosive conditions involved) where the coating residual thickness was up to about 0.6 mm. These results show that the tested anode assembly as a potential candidate for carbon anode replacement.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An electrolytic cell comprising a protective layer comprising copper atoms or ions, in any oxidation state, covering at least in part or all of a refractory material assembly covering an interior surface thereof, said protective layer being formed from a copper oxide containing composition, a composite material comprising copper atoms or ions, in any oxidation state, or a combination thereof, and said protective layer being a randomly arranged, continuous copper containing ceramic matrix comprising a plurality of continuous copper paths in electrical communication with said refractory material assembly on one side, and an electrolyte on the other side.

2. The electrolytic cell of claim 1, wherein said protective layer comprising copper atoms or ions, in any oxidation state, further comprises a copper sheet, a structure comprising copper atoms or ions, in any oxidation state, a copper oxide, and combinations thereof.

3. The electrolytic cell of claim 2, wherein said protective layer comprising copper atoms or ions, in any oxidation state, comprises a plurality of copper sheets, and said copper oxide, said composite material comprising copper atoms or ions, in any oxidation state, said copper oxide containing composition or combinations thereof, between said copper sheets.

4. The electrolytic cell of claim 2, wherein said copper oxide or said copper oxide containing composition is in powder form, paste form, mortar form, slurry form, grouting form, or combinations thereof.

5. The electrolytic cell of claim 2, wherein said copper oxide containing composition comprises from about 35 to 100% w/w of said copper oxide.

6. The electrolytic cell of claim 2, wherein said copper oxide is CuO, $Cu_2O$, $CuO_2$; $Cu_2O_3$, or a combination thereof.

7. The electrolytic cell of claim 2, wherein said copper oxide containing composition further comprises a reducible copper containing compound.

8. The electrolytic cell of claim 7, wherein said copper oxide containing composition comprises from about 35 to 100% w/w of said copper oxide and said reducible copper containing compound.

9. The electrolytic cell of claim 2, wherein said copper oxide containing composition further comprises a metallic copper particle.

10. The electrolytic cell of claim 2, wherein said copper oxide containing composition further comprises a reducing agent, a lubricating agent, a filler material, a binder, water, and combinations thereof.

11. The electrolytic cell of claim 10, wherein said reducing agent is graphite, lithium aluminium hydride ($LiAlH_4$), diborane sodium borohydride ($NaBH_4$), compounds containing the $Fe^{2+}$ ion, compounds containing the $Sn^{2+}$ ion, sulfur dioxide, sulfite compounds, dithionates, thiosulfates, Iodides, Cyanides, carbon forms distinct from graphite, or combinations thereof, or wherein said lubricating agent is graphite, molybdenum disulfide ($MoS_2$), boron nitrite, polytetrafluorethylene (PTFE), or combinations thereof.

12. The electrolytic cell of claim 10, wherein said lubricating agent or said reducing agent is each from about 5 to about 15% w/w of the composition, or wherein said graphite is from about 5 to about 15% w/w of the composition, or wherein said filler material is from about 0 to about 25% w/w of the composition or wherein said binder is from about 0 to about 15% w/w of the composition.

13. The electrolytic cell of claim 10, wherein said filler material is silicon carbide (SiC), ground calcium carbonate (GCC), precipitated calcium carbonate (PCC), kaolin, talc, Wollastonite ($CaSiO_3$), Silica (Precipitated), glass, carbon black, or combinations thereof.

14. The electrolytic cell of claim 13, wherein said SiC is from about 0 to about 25% w/w of the composition.

15. The electrolytic cell of claim 10, wherein said binder is bentonite, kaolinite, halloysite, phyrophillite, monmorillonite, or combinations thereof.

16. The electrolytic cell of claim 10, wherein said filler material has a particle size of from about 75 μm to about 3350 μm, or wherein said binder has a particle size of about 10 μm to about 44 μm.

17. The electrolytic cell of claim 2, wherein said copper oxide containing composition contains copper oxide particles of about 10 μm to about 200 μm.

18. The electrolytic cell of claim 1, wherein said electrolytic cell comprises a shell defining said interior surface, said refractory material assembly covering said interior surface at a bottom of said shell.

* * * * *